US010252146B2

(12) United States Patent
Ritter

(10) Patent No.: US 10,252,146 B2
(45) Date of Patent: Apr. 9, 2019

(54) SPLITBOARD LATCHING DEVICE

(71) Applicant: Spark R&D IP Holdings, LLC, Bozeman, MT (US)

(72) Inventor: William J. Ritter, Bozeman, MT (US)

(73) Assignee: Spark R&D IP Holdings, LLC, Bozeman, MT (US)

( * ) Notice: Subject to any disclaimer, the term of this patent is extended or adjusted under 35 U.S.C. 154(b) by 0 days.

(21) Appl. No.: 15/872,337

(22) Filed: Jan. 16, 2018

(65) Prior Publication Data

US 2018/0200606 A1 Jul. 19, 2018

Related U.S. Application Data

(60) Provisional application No. 62/447,434, filed on Jan. 17, 2017.

(51) Int. Cl.
*A63C 5/02* (2006.01)
*A63C 5/03* (2006.01)

(52) U.S. Cl.
CPC ..... *A63C 5/033* (2013.01); *A63C 5/02* (2013.01); *A63C 5/031* (2013.01); *A63C 2203/06* (2013.01); *A63C 2203/10* (2013.01)

(58) Field of Classification Search
CPC .. A63C 5/02; A63C 5/03; A63C 5/031; A63C 5/16; A63C 2203/06; A63C 10/14
See application file for complete search history.

(56) References Cited

U.S. PATENT DOCUMENTS 5,109,616 A 5/1992 Lush
5,462,318 A 10/1995 Cooke
5,551,728 A 9/1996 Barthel et al.
5,558,354 A 9/1996 Lion
5,649,722 A 7/1997 Champlin
5,660,416 A * 8/1997 Schiele ..... A63C 5/031 280/14.21
5,984,324 A 11/1999 Wariakois
(Continued)

FOREIGN PATENT DOCUMENTS

DE 9108618 U1 11/1991
JP 5620597 B1 11/2014

OTHER PUBLICATIONS

Voile Cam Bushings Instructions, Nov. 2014, Voile Manufacturing, Salt Lake City, Utah.
(Continued)

*Primary Examiner* — Bryan A Evans
(74) *Attorney, Agent, or Firm* — Stone Creek Services LLC; Alan M Flum

(57) ABSTRACT

A latching device that joins splitboard skis along lengthwise edges. The latching device can include a bracket assembly and a crossbar assembly. The bracket assembly can be secured to a first splitboard ski. The crossbar assembly can be secured to a second splitboard ski. The crossbar assembly can include a crossbar and a lever rotationally coupled to the crossbar. The bracket assembly can include a bracket. Rotating the lever can apply a compressive force between the lever and the inside edge of the bracket applying a holding force between the first splitboard ski and the second splitboard ski. With the splitboard skis disengaged, the bracket assembly and crossbar assembly can be stowed completely within their respective splitboard ski perimeter boundaries.

21 Claims, 25 Drawing Sheets

(56) References Cited

U.S. PATENT DOCUMENTS

| | | | | |
|---|---|---|---|---|
| 6,523,851 | B1 | 2/2003 | Maravetz | |
| 8,033,564 | B2 | 10/2011 | Riepler et al. | |
| 8,469,372 | B2 | 6/2013 | Kloster et al. | |
| 8,708,371 | B2 | 4/2014 | Balun | |
| 8,733,783 | B2 | 5/2014 | Kloster et al. | |
| 8,764,043 | B2 | 7/2014 | Neubauer et al. | |
| 9,132,336 | B2 | 9/2015 | Bulan | |
| 9,138,628 | B2 | 9/2015 | Kloster et al. | |
| 9,227,131 | B2 | 1/2016 | Adamczewski et al. | |
| 9,238,168 | B2 | 1/2016 | Kloster et al. | |
| 9,266,010 | B2 | 2/2016 | Kloster et al. | |
| 9,604,122 | B2 | 3/2017 | Kloster et al. | |
| 9,795,861 | B1 | 10/2017 | Kloster et al. | |
| 9,821,214 | B2 | 11/2017 | Browning | |
| 2012/0274036 | A1 | 11/2012 | Kloster et al. | |
| 2015/0014962 | A1* | 1/2015 | Rayner | A63C 10/145 280/611 |
| 2016/0175685 | A1 | 6/2016 | Kloster et al. | |
| 2016/0310824 | A1 | 10/2016 | Kloster et al. | |
| 2016/0310825 | A1 | 10/2016 | Kloster et al. | |
| 2018/0140930 | A1 | 5/2018 | Kloster et al. | |
| 2018/0140931 | A1 | 5/2018 | Kloster et al. | |

OTHER PUBLICATIONS

Voile Split Hook Cam Bushing Kit, accessed on the Internet at http://www.voile.com/voile-split-hook-cam-bushing-kit.html on Jan. 4, 2018.

Nitro Splitboard Hooks, Snowboard Zezula, accessed on the Internet at https://www.snowboard-zezula.com/nitro-splitboard-hooks/pn-94370 on Jan. 4, 2018.

Fritschi Tour Snowboard Bindings, from Nitro Snowboards 1993-1994 Catalog, Jan. 1993, Nitro Snowboards, Oberammergau, Germany.

Phantom Splitboard Bindings, accessed on the Internet at http://www.phantomsnow.com/shop/parts-accessories/hercules-hooks/ on Jan. 4, 2018.

Crochets WOM, Hook WOM Pack for splitboards, accessed on the Internet at https://www.fixation-plum.com/en/accessoires-splitboard/6000-crochets-wom.html on Jan. 4, 2018.

Cowboy Clips, accessed on the Internet at https://www.prowder.com/product/cowboy-clips/ on Jan. 4, 2018.

Splitlock Technology, Oz Snowboards, accessed on the Internet at https://www.ozsnowboards.com/pages/splitlock on Jan. 4, 2018.

SpurArt Splitboard Hooks, Flickr, accessed on the Internet at https://www.flickr.com/photos/spurart/22721203059/in/photostream/ on Jan. 4, 2018.

* cited by examiner

SPLITBOARD LATCHING DEVICE

CROSS-REFERENCE TO RELATED APPLICATIONS

This application claims the benefit of U.S. Provisional Application No. 62/447,434, filed on Jan. 17, 2017.

BACKGROUND

The present disclosure relates to splitboards. A splitboard is a snow gliding board separable into re-joinable splitboard skis. The disclosure particularly relates to devices for latching the splitboard skis together.

Snowboarding is a recreational activity where a rider glides down a snow-covered mountain, hill, or slope while standing with their feet attached to a single snow glide board known as a snowboard. The concept is like snow skiing except when gliding downhill, both feet are attached to a single snow glide board instead of each foot attached to its own separate ski.

Snowboard riders or "snowboarders" often share downhill snow-covered slopes with skiers. Popular downhill slopes are often accessed by ski lifts to take the skier or snowboarder up to the top of the slope. Some snowboarders are interested in accessing downhill slopes in the backcountry away from crowded ski slopes and where the snow is fresh. However, climbing up mountains and slopes with thick fresh soft snow can be challenging.

Splitboards were developed to allow snowboarders access to the backcountry and areas not normally accessible to snowboarders. A splitboard is a snowboard separable into two separate splitboard skis. To climb uphill, or "tour," the backcountry, the splitboard rider separates the splitboard and uses it like cross-country skis. This is "touring mode." To ride downhill, the splitboard rider rejoins the splitboard skis and rides the splitboard as they would an ordinary snowboard. This is "riding mode."

Boot bindings hold the splitboard rider's boots to the splitboard. In touring mode, one boot binding is attached to each splitboard ski like cross-country skis. In riding mode, the boot bindings are fastened across the splitboard skis and hold the splitboard skis together. Nose and tail clips help keep the forward tip and rearward tip of the splitboard skis from separating.

Riding mode requires a sturdy union at the seam between the two splitboard ski halves. Even with boot binding and nose and tail clips holding the board together, there may still be looseness or play between the two splitboard ski halves. If there is play or looseness along the seam in a splitboard, torsional stiffness will not be not optimal and the splitboard skis may flex relative to each other causing the board to behave unpredictably. This can cause the splitboard rider to lose control of the splitboard. Shear forces between the seam and the board face can cause up and down motion of one splitboard ski relative to the other. This can cause one of the splitboard skis to snag in the snow leading to the rider falling.

Latching devices can be placed along intermediate points along the length of the seam between the two splitboard skis to help increase torsional stiffness and reduce flexing of the splitboard skis relative to each other. These latching devices have taken various forms such as buckles or hook clips. These latching devices go by various names in the splitboard trade, depending on their structure; for example, splitboard clips, splitboard hooks, or split hooks.

SUMMARY

The inventor observed there could be advantages to a latching device with a simpler design and one that better resisted the shear forces that cause up and down motion of one ski relative to the other. The inventor developed a latching device he calls a crossbar clip. The latching device can include a bracket assembly secured to a first splitboard ski and a crossbar assembly secured to a second splitboard ski. The bracket assembly can include a bracket. The crossbar assembly can include a crossbar and a lever rotationally coupled to the crossbar. The bracket assembly and crossbar assembly can be aligned so rotation of the lever applies a force between the lever and the inside edge of the bracket. This compressive force creates a holding force between the first splitboard ski to the second splitboard ski. In addition, the compressive force between the bracket assembly and the crossbar assembly can optionally be adjusted by changing the distance between the inside edge of the bracket and the lengthwise edge of the first splitboard ski.

The lever can include a lever edge that can directly engage the inside edge of the bracket. The lever can include a projected portion or an eccentric portion that engages either directly or indirectly the inside edge of the bracket. The projected portion can project downward from the lever toward the first splitboard ski and can project about an axis of rotation of the lever. Rotation of the lever can apply a compressive force between the projected portion and the inside edge of the bracket which applies a holding force between the first splitboard ski and the second splitboard ski. The eccentric portion is offset (i.e. eccentric or not centered) to the rotational axis of the lever. The bracket assembly and crossbar assembly can be aligned so rotation of the lever applies a force between the eccentric portion and the inside edge of the bracket. The inventor envisions that the lever edge, the projected portion, or the eccentric portion can take on many shapes that create a compressive force with bracket as the lever is rotated. For example, the projected portion, eccentric portion, or lever edge can be a logarithmic spiral or a non-uniform rational basis spline (NURBS).

The bracket assembly can be constrained to within the inside lengthwise edge of the first splitboard ski and generally confined within perimeter boundary of the first splitboard ski. A portion of the crossbar can be positioned between the bracket and first splitboard ski. This creates a wedging effect that prevents up and down movement between the first splitboard ski and the second splitboard ski.

The latching device has advantages and unexpected results. First, the latching device can have holding strength greater than many other latching devices. This can increase ride performance and improve safety. Second, the latching device can have superior holding power with fewer parts. This can make the latching device more reliable with fewer parts to fail improving field serviceability. Third, the latching device can include a threaded fastener that allows for fine adjustment and is independent of the fasteners that retain the bracket assembly to the first splitboard ski. Once fine adjustment is made, the fasteners retaining the bracket assembly can be further tightened while the bracket is in the latched position to prevent movement of the bracket when it is in the unlatched position. Fourth, the latching device assembly can assume a touring mode position where both the crossbar assembly and the bracket assembly can be fully within the perimeter of their respective splitboard skis. No portion of either assembly projects from the edges of the splitboard skis to catch on rocks, branches, and other obstacles. This improves safety and allows for less interruptions when touring. Fifth, the latching device can prevent up and down motion between the first splitboard ski relative to the second splitboard ski. This can increase the safety and performance.

The inventor envisions that the latching device can be implemented with variations and improvements that all fall within the scope of his latching device. For example, the bracket assembly could include a bracket with a first bracket portion slidable within a base laterally regarding the inside lengthwise edge of the first splitboard. A threaded fastener can set the limit of the range of motion of the bracket toward the lengthwise edge of the first splitboard ski. When a force is applied to the inside edge of the bracket toward the second splitboard ski, the bracket will move against the threaded fastener. For example, when the eccentric portion engages the inside edge of the bracket, it will apply a force to the bracket toward the second splitboard ski. This bracket assembly is not limited to the latching device with a crossbar and lever but can be used with any splitboard latching device that applies pressure toward the second splitboard member on a bracket assembly secured to the first splitboard member.

This Summary introduced a selection of concepts in simplified form described the Description. The Summary is not intended to identify essential features or limit the claimed subject matter.

DESCRIPTION

The terms "top, "bottom," "upper," "front," and "back," are relative terms used throughout the to help the reader understand the figures. Unless otherwise indicated, these do not denote absolute direction or orientation and do not imply a preference. When describing the figures, the terms "top," "bottom," "front," "rear," are from the perspective of how a typical splitboard rider would view the splitboard or components while standing on the board in a conventional riding or touring position. Specific dimensions should help the reader understand the scale and advantage of the disclosed material. Dimensions given are typical and the claimed invention is not limited to the recited dimensions. The figures are not necessarily to scale.

Certain features or components and some details of conventional elements may not be shown in the interest of clarity, explanation, and conciseness. For example, a splitboard may include bindings for securing the rider's feet to the splitboard. The splitboard may also include hardware associated with the bindings such as pucks, tracks, sliders, and climbing bars. The splitboard may also include tip and tail hooks for stabilizing the front and rear ends of the splitboard respectively. These parts are omitted for clarity. In the present disclosure they represent part of the environment and one of ordinary skill in the art ready knows how to apply them to a splitboard.

Referring to similarly named part with an ordinal prefix such as first, second, or third helps distinguish the parts from one another when referred to together. This implies no preference of one part over the other. Similarly, referring to examples using ordinal prefixes or as alternative examples, does such not infer any preference of one example over the other.

The Description refers to figures, where like numerals refer to like elements throughout the several views. FIGS. 1-3, 5, 7-28 and 30-37 illustrate a latching device 1 or portions of the latching device 1, conceived and implemented by the inventor, for joining splitboard skis of a splitboard 3. FIGS. 38-42 illustrate an alternative implementation of a latching device 40, conceived and implemented by the inventor, for joining splitboard skis of a splitboard 3, that shares common principles of operation with the latching device 1 of FIGS. 1-3, 5, 7-28 and 30-37. These common principles will be discussed within this Description.

Figure 29:
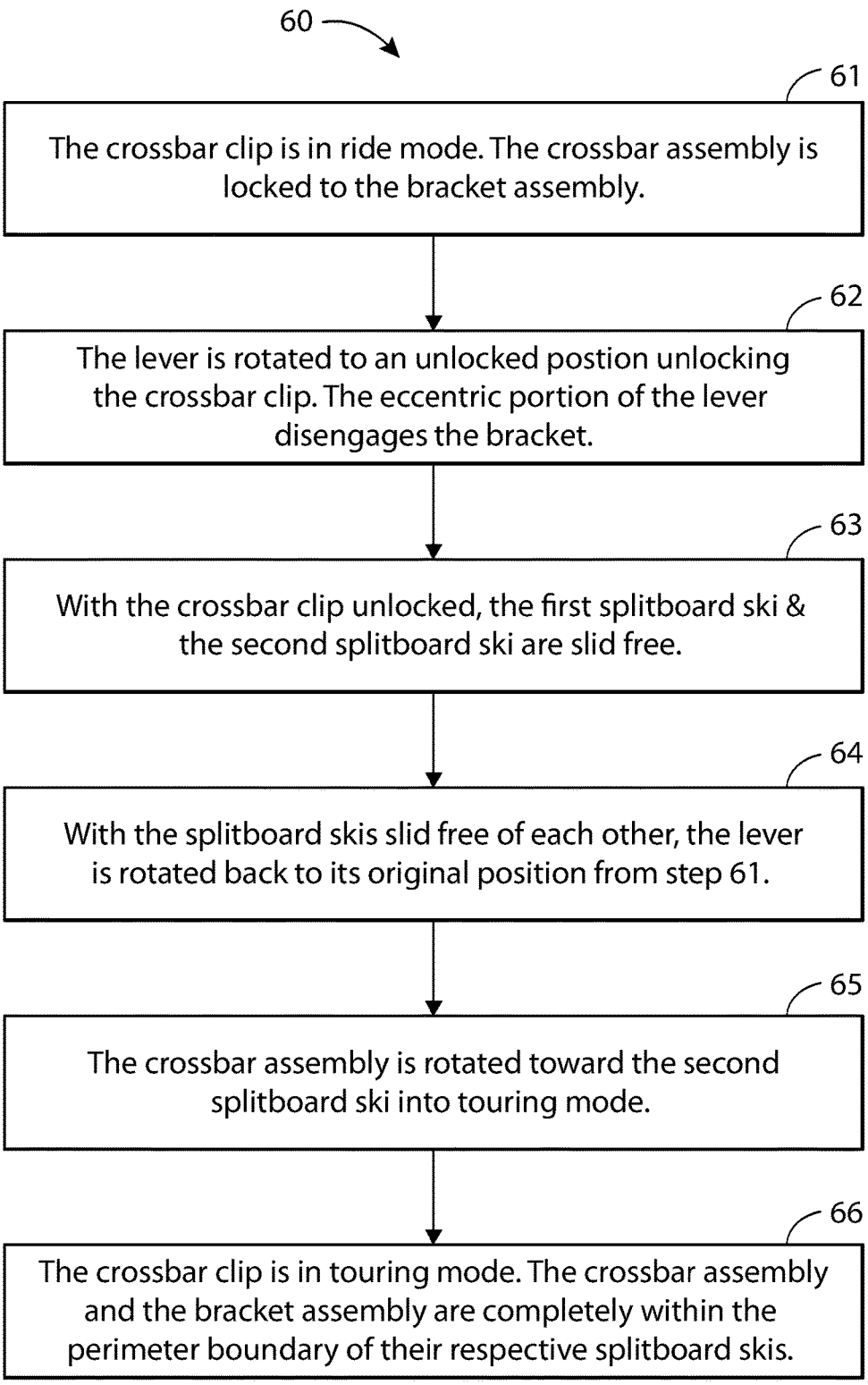
FIG. 29 illustrates a flow diagram showing the sequence of going from riding mode to touring mode illustrated in FIGS. 1-28.
Figure 30:
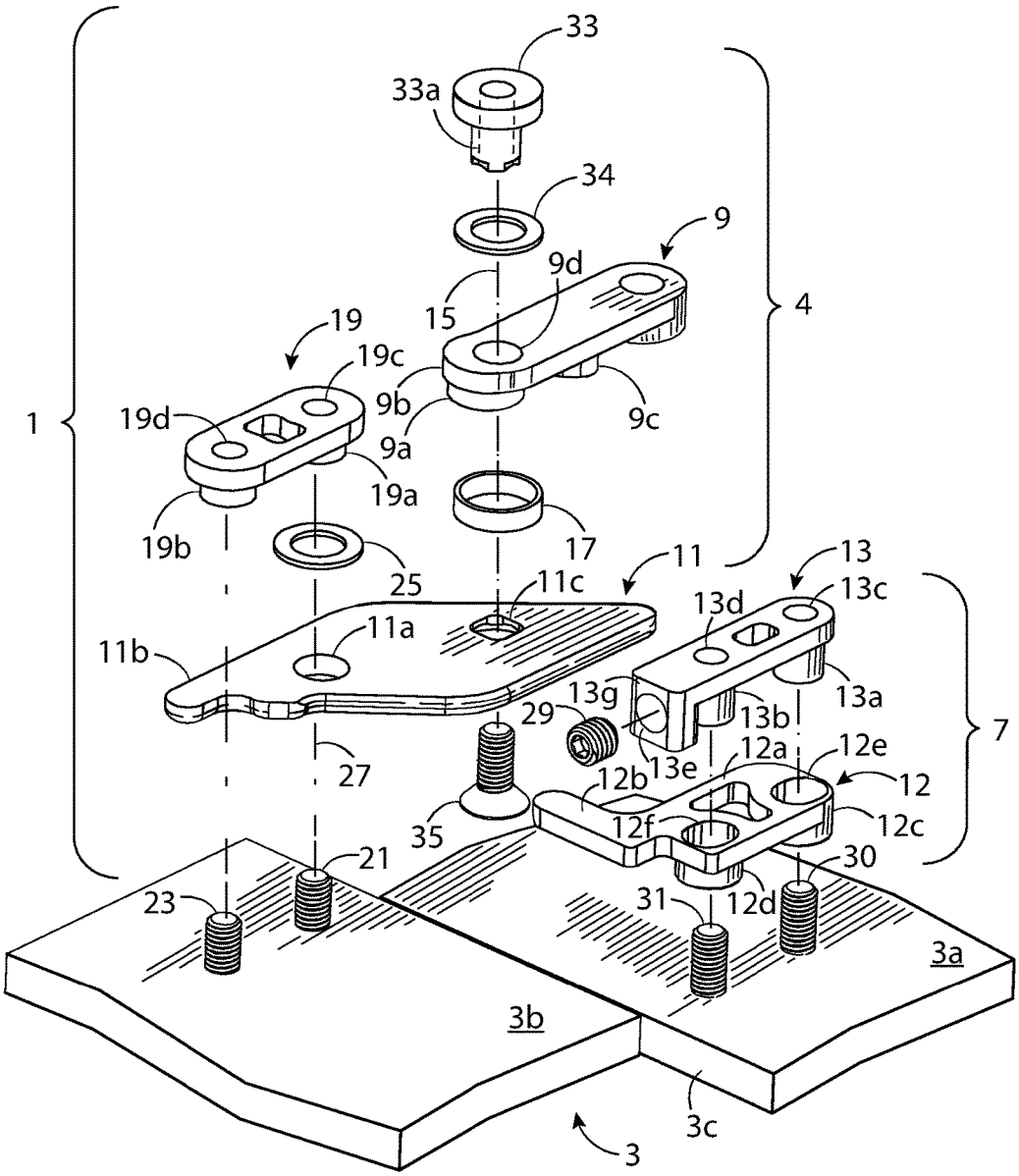
FIG. 30 illustrates an exploded top perspective view of the latching device and a portion of the splitboard of FIG. 1.

FIGS. 1-28 illustrate in top perspective view (FIGS. 1, 7, 13, 17, 21 and 25), enlarged partial perspective view (FIGS. 11 and 12), top view (FIGS. 3, 9, 15, 19, 23, and 27), bottom view (FIG. 4), and enlarged partial views (FIGS. 2, 5, 6, 8, 10, 14, 16, 18, 20, 22, 24, 26, and 28) various features of the latching device 1 by demonstrating how to go from riding mode to touring mode. The latching device 1 includes a crossbar assembly 4 (FIGS. 1-3, 5, 7-28) and a bracket assembly 7 (FIGS. 1-3, 5, 7-17, 19, 21, 23, 25-28). The bracket assembly 7 is secured to a first splitboard ski 3*a*. The crossbar assembly 4 is secured to a second splitboard ski 3*b*. FIG. 29 illustrates a flow diagram showing a sequence 60 or steps of going from riding mode to touring mode illustrated in FIGS. 1-28. FIG. 30 illustrates an exploded top perspective view that includes the latching device 1 and a portion of each of the splitboard 3, the first splitboard ski 3*a*, and the second splitboard ski 3*b*. Referring to FIGS. 2, 5, 8, 10-12, 14, 16, 18, 20, 22, 24, 26, 28, 30, and 31, the crossbar assembly 4 includes a lever 9 and a crossbar 11. The lever 9 is rotationally coupled to the crossbar 11. The bracket assembly 7 includes a bracket 12 and can include a bracket base 13 (FIGS. 2, 5, 8, 10-12, 14, 16, 26, 28, and 30). FIGS. 1-6 and 11, illustrate the splitboard 3 in riding mode with the crossbar assembly 4 and the bracket assembly 7 (FIGS. 1-3, 5, and 11) in a locked position, securing a first splitboard ski 3*a* and a second splitboard ski 3*b* together. In FIG. 29, this is step 61. FIGS. 7-10 and 12 illustrate the crossbar assembly 4 and the bracket assembly 7 in an unlocked position. In FIG. 29, this is step 62. FIGS. 13-16 illustrate the crossbar assembly 4 and the bracket assembly 7 in the unlocked position of FIG. 7 and with the first splitboard ski 3*a* and the second splitboard ski 3*b* slid free from each other. In FIG. 29, this is step 63. FIGS. 17-20 illustrate the splitboard 3 and the latching device 1 with the first splitboard ski 3*a* and the second splitboard ski 3*b* (FIGS. 17 and 19) are slid free from each other and separated apart with a lever 9 of a crossbar assembly 4 rotated back to its original position from FIG. 1. In FIG. 29, this is step 64. FIGS. 21-24 illustrate the crossbar assembly 4 being rotated toward the second splitboard ski 3*b* into a touring mode position. In FIG. 29, this is step 65. FIGS. 25-28 illustrate the splitboard 3 and the latching devices 1 in touring mode. In FIG. 29, this is step 66. In touring mode, the crossbar assembly 4 and the bracket assembly 7 are completely within the perimeter boundary of their respective splitboard skis. To go from touring mode to riding mode, the steps are reversed, starting with step 66 and ending with step 61.

Figure 39:
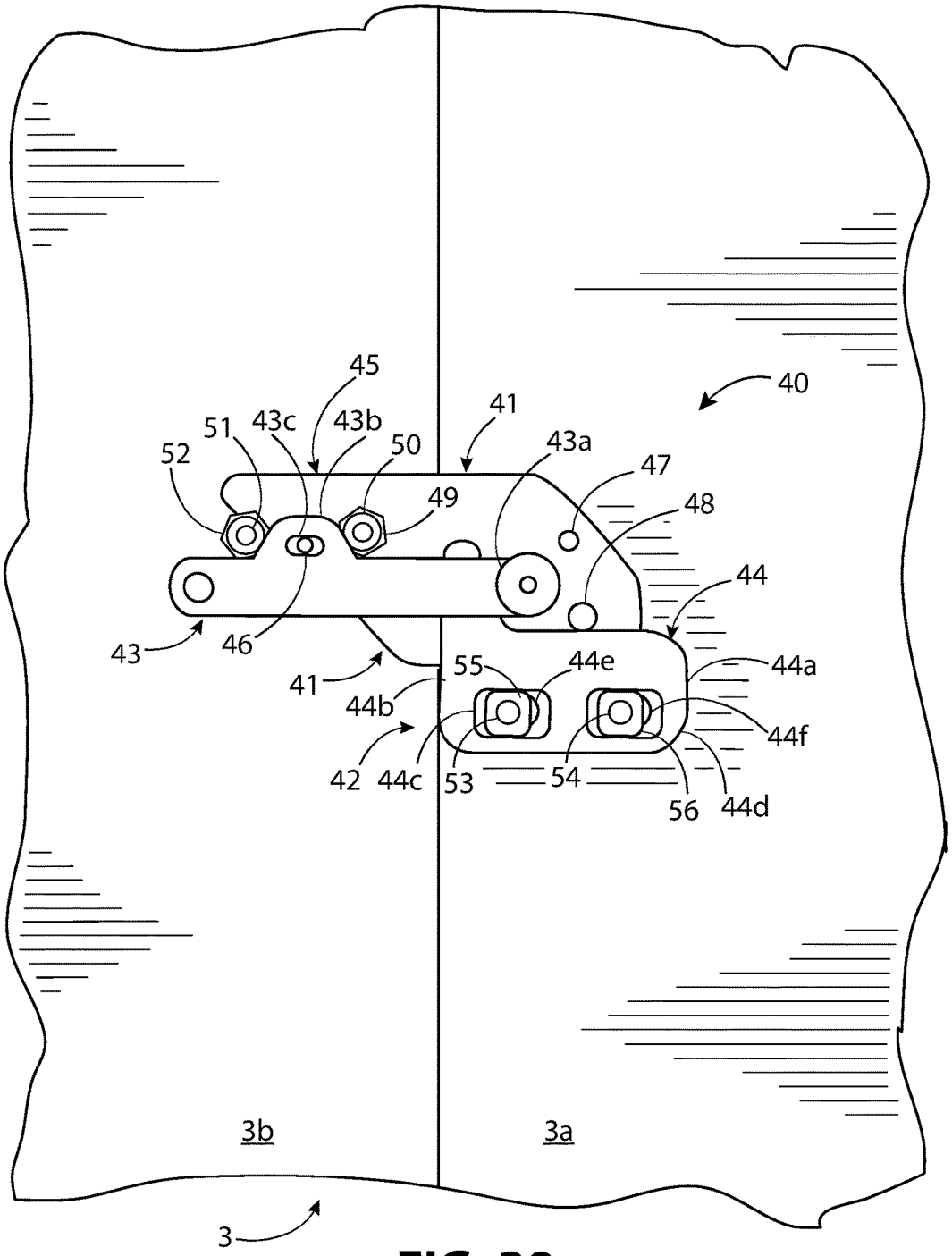
FIG. 39 illustrates, in top view, the latching device of FIG. 38 and a portion of the splitboard where the latching device is in a locked position for riding mode.
Figure 40:
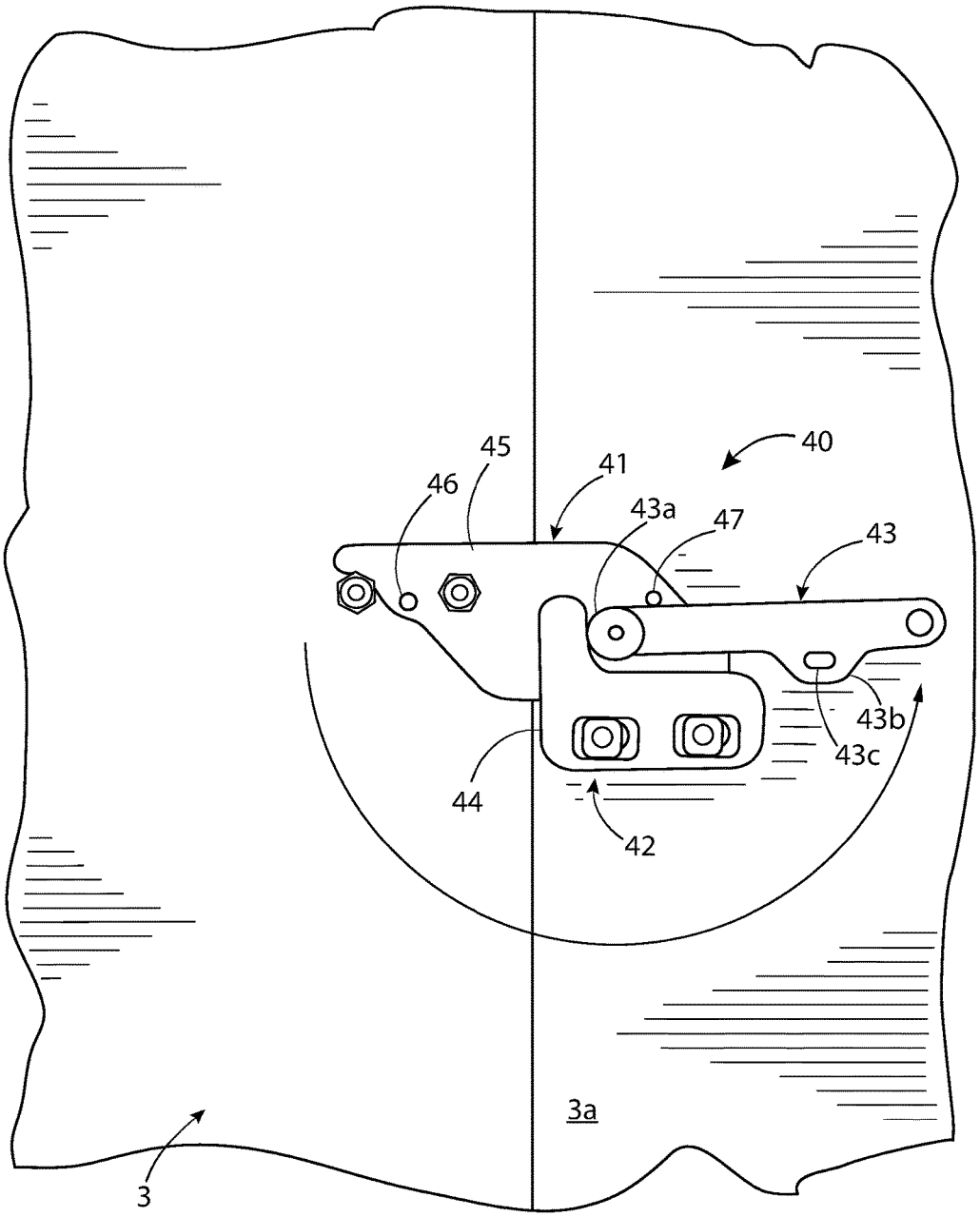
FIG. 40 illustrates, in top view, the latching device and the portion of the splitboard illustrated in FIG. 39, where the lever is rotated to unlock the bracket assembly from the crossbar assembly.
Figure 41:
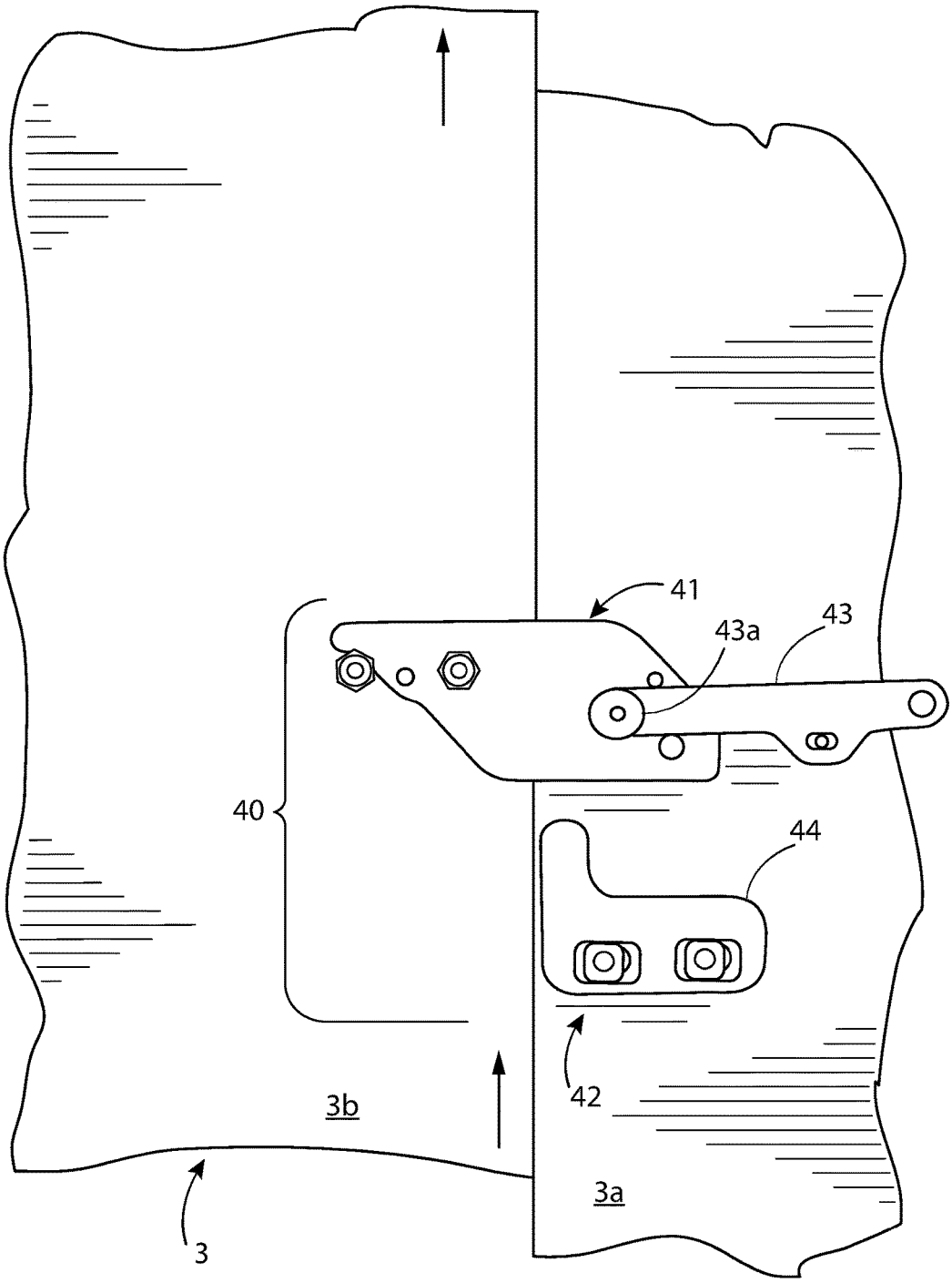
FIG. 41 illustrates, in top view, the latching device and the portion of the splitboard illustrated in FIG. 39, with the latching devices in the unlocked position of FIG. 37 and with the first splitboard ski slid free of the second splitboard ski.
Figure 42:
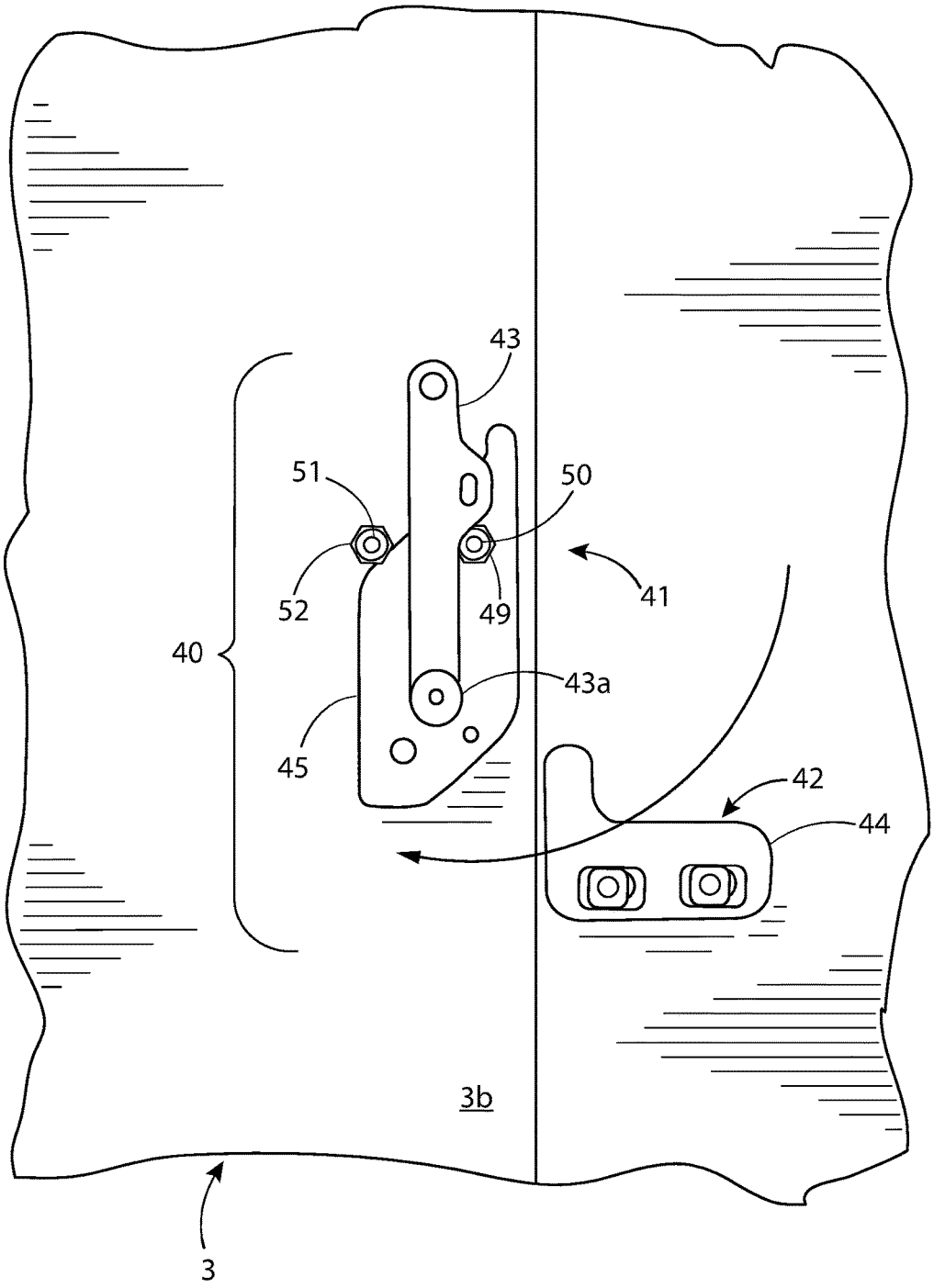
FIG. 42 illustrates, in top view, the latching device and portion of the splitboard illustrated in FIG. 39, where the crossbar and lever are rotated toward the second splitboard ski into touring mode with the entire latching device assembly resides within the perimeter of the second splitboard ski.
Figure 43:
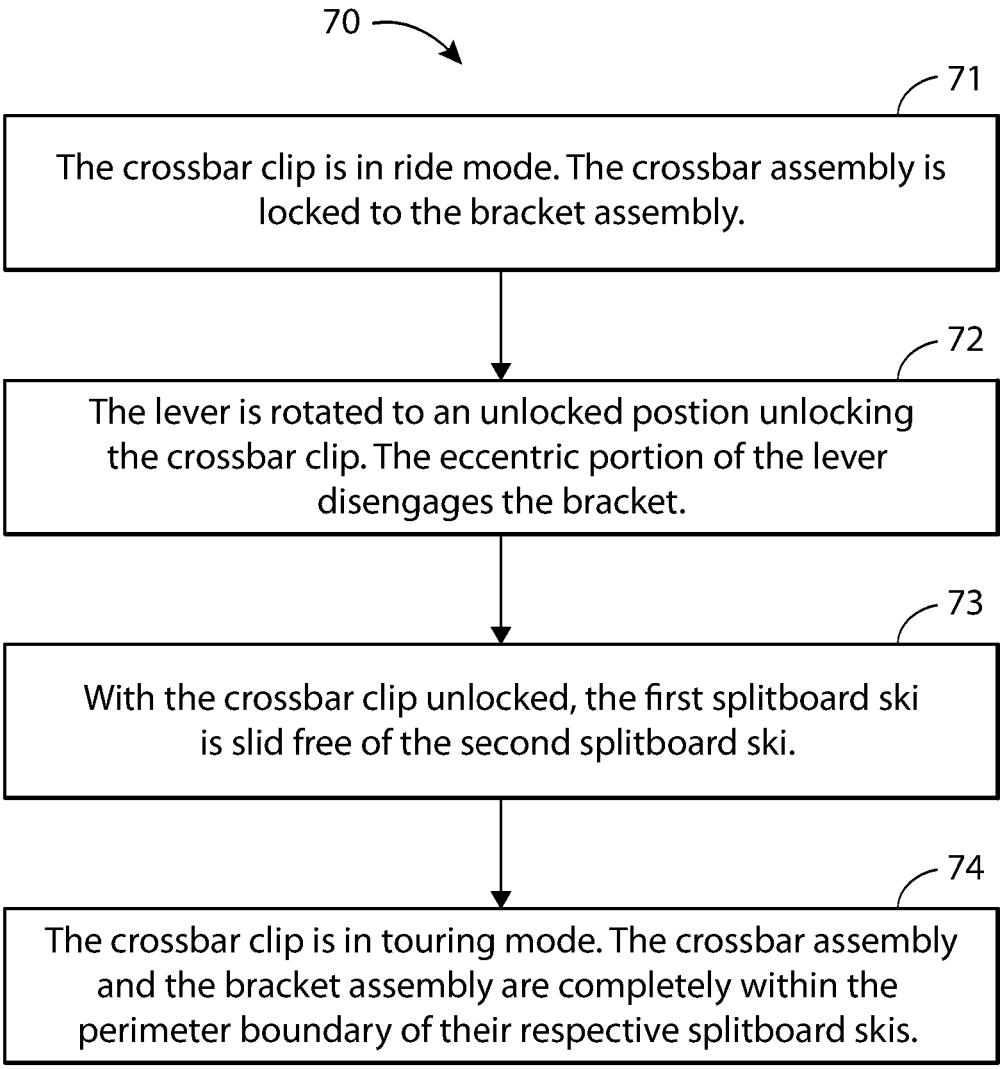
FIG. 43 illustrates a flow diagram showing the sequence of going from riding mode to touring mode illustrated in FIGS. 39-42.

FIG. 38-42 illustrate various features of alternative version of the latching device 40 by demonstrating how to go from riding mode to touring mode. FIG. 43 illustrates a flow diagram showing the sequence 70 of going from riding mode to touring mode illustrated in FIGS. 39-42. Referring to FIGS. 38-42, the latching device 40 includes a crossbar assembly 41 and a bracket assembly 42. In FIG. 39, the crossbar assembly 41 and bracket assembly 42 are locked together for riding mode. In FIG. 43, this is step 71. In FIG. 40, a lever 43, that forms a part of the crossbar assembly 41, is rotated to unlock the bracket assembly 42 from the crossbar assembly 41. In FIG. 43, this is step 72. FIG. 41 illustrates the latching device 40 in the unlocked position of FIG. 40 and with the second splitboard ski 3*b* and the first splitboard ski 3*a* are slid free of each other. In FIG. 43, this is step 73. FIG. 42 illustrates the crossbar assembly 41 rotated toward the second splitboard ski 3*b* into touring mode with the crossbar assembly 41 entirely residing within the perimeter of the second splitboard ski 3*b*. In FIG. 43, this is step 74. To go from touring mode to riding mode, the steps are reversed, starting with step 74 and ending with step 71.

Figure 31:
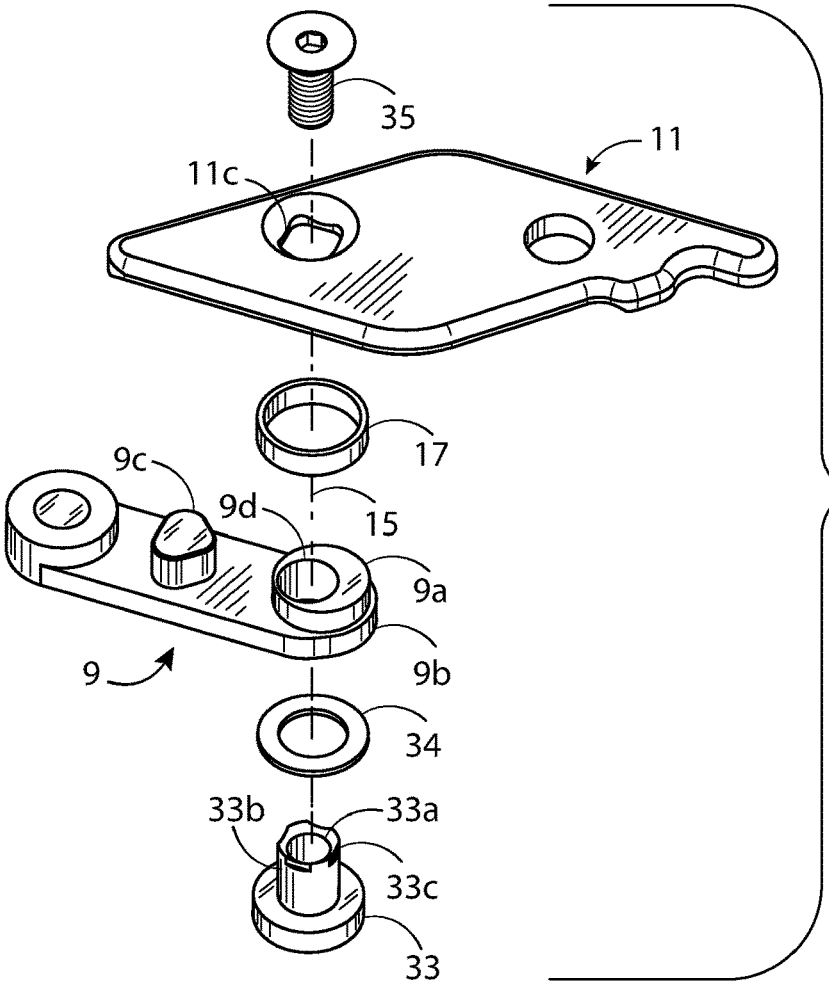
FIG. 31 illustrates an exploded bottom perspective view of a lever assembly and the crossbar of the latching device of FIG. 1.
Figure 33:
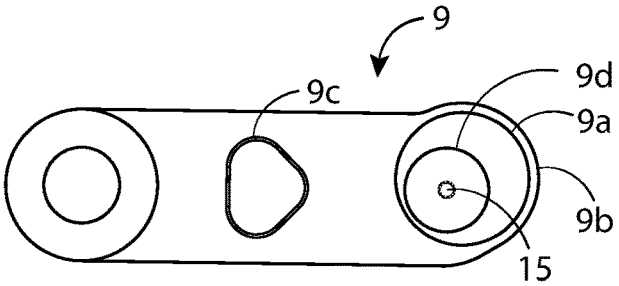
FIG. 33 illustrates a bottom view of the lever.

Referring to FIGS. 2, 5, 11, and 30, the latching device 1 depends on compressive force between a projected portion 9*a* and the bracket 12 to hold the crossbar assembly 4 and the bracket assembly 7 together. Referring to FIGS. 30, 31, and 33, the projected portion 9*a* can be an eccentric portion. An eccentric portion is so called because it is not centered (i.e., eccentric) about the rotational axis 15 of the lever 9. The projected portion 9*a* can also be other shapes that create a compressive force as the lever 9 is rotated. For example, it can be a logarithmic spiral or can be NURBS. The projected portion 9*a* is illustrated as, integral with, and projecting directly from, the lever 9. The projected portion 9*a* can be a separate member from the lever 9 but rotationally coupled to it (i.e., rotates with the lever 9 as the lever 9 is rotated).

Figure 2:
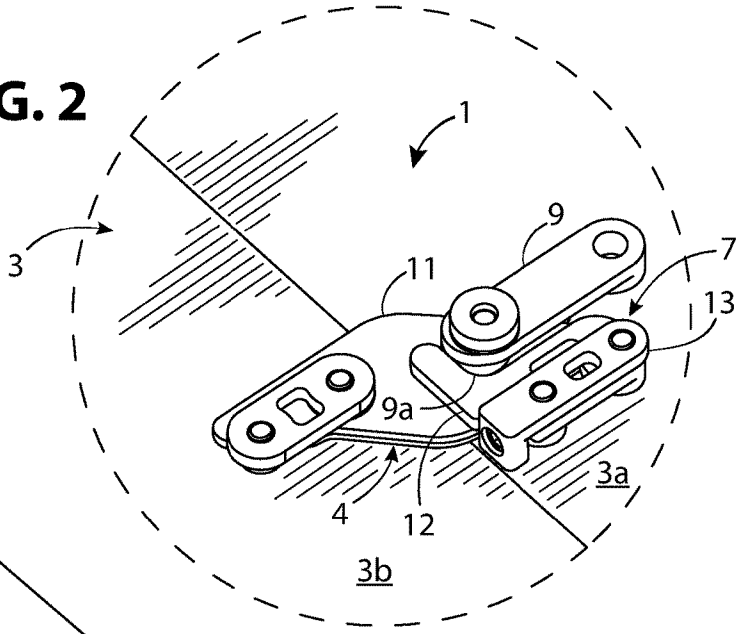
FIG. 2 illustrates an enlarged partial view of FIG. 1 showing one of the latching devices.
Figure 1:
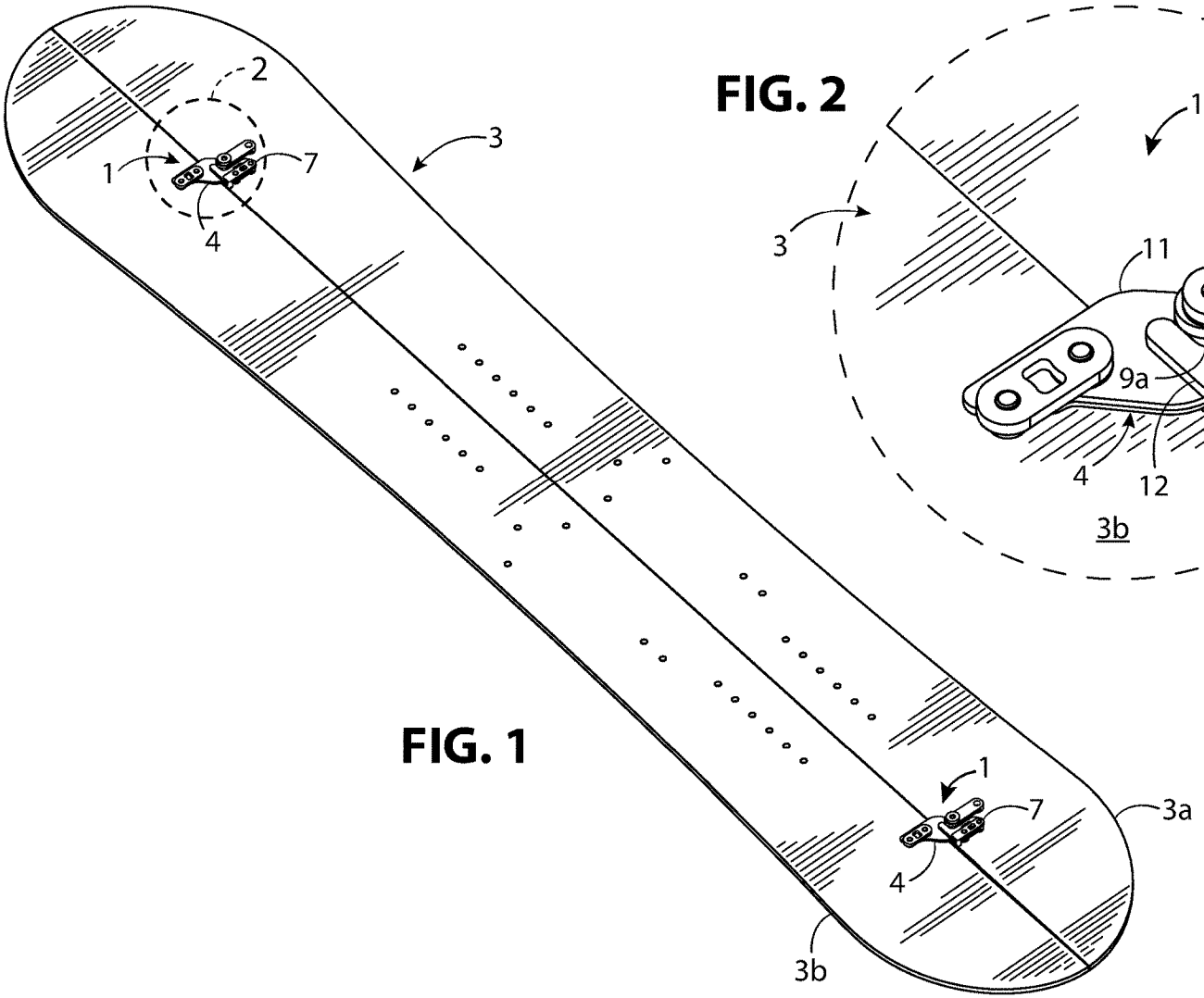
FIG. 1 illustrates, in top perspective view, a splitboard in riding mode with a pair of latching devices in the locked position securing a first splitboard ski and a second splitboard ski together.
Figure 3:
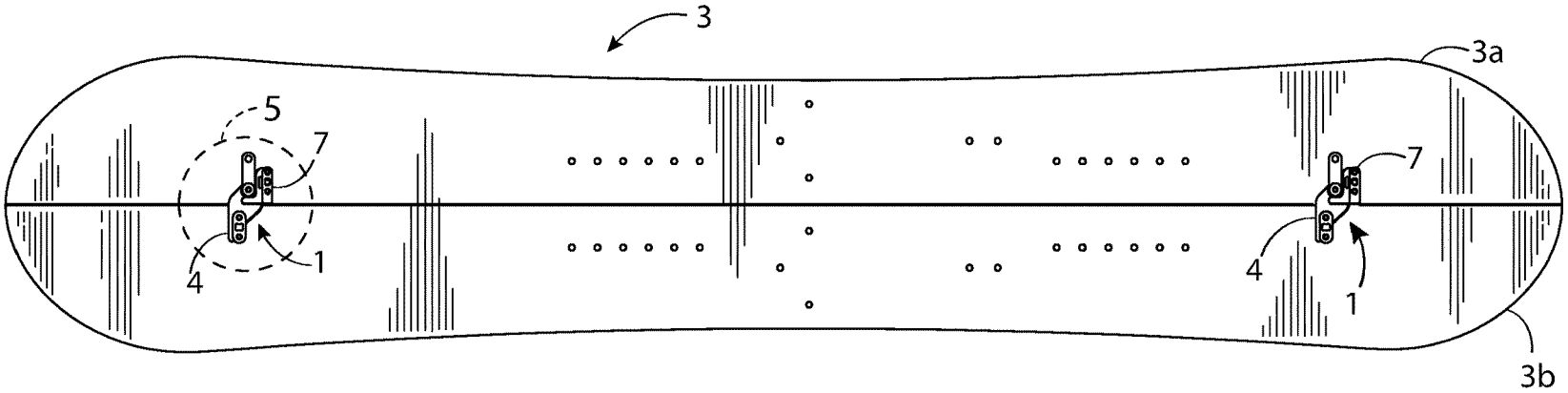
FIG. 3 illustrates a top view of the splitboard and latching devices of FIG. 1.
Figure 4:
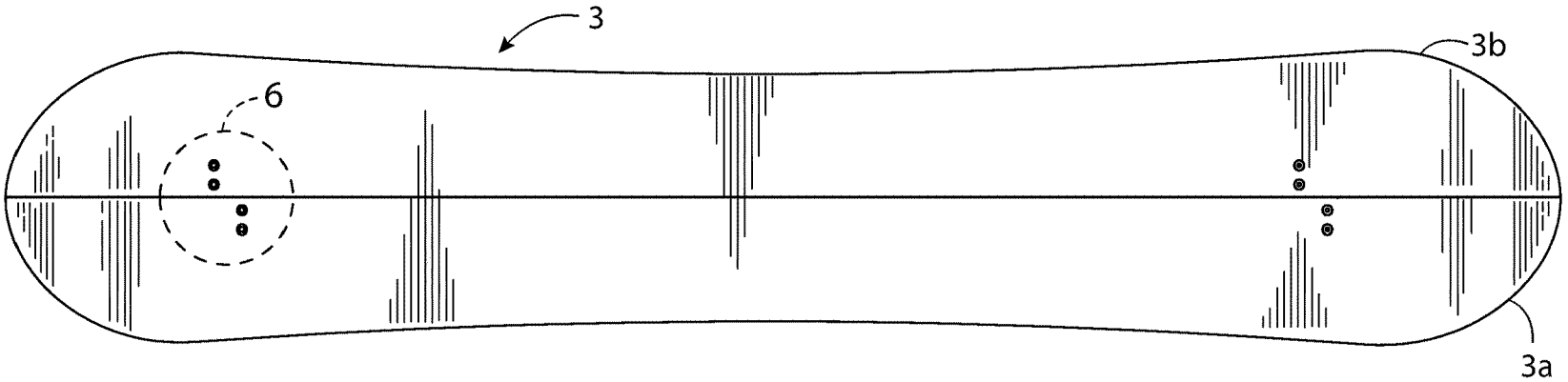
FIG. 4 illustrates a bottom view of the splitboard and latching devices of FIG. 1.

One important advantage of the latching device 1 is that it counteracts or resists shear forces between the first splitboard ski 3*a* and the second splitboard ski 3*b*. Shear forces can cause up and down motion of one splitboard ski relative to the other. This can cause one of the splitboard skis to snag in the snow leading to the rider falling. Referring to FIGS. 2 and 30, a portion of the crossbar 11 is positioned between the bracket 12 and first splitboard ski 3*a*. The bracket assembly 7 is confined within the perimeter boundary of the first splitboard ski 3*a* (i.e., the bracket assembly 7 is constrained to within the inside lengthwise edge 3*c* (FIG. 30). This combination helps prevent up and down movement between the first splitboard ski 3*a* and the second splitboard ski 3*b*.

In FIGS. 38-42, the latching device 40 similarly depends on compressive force between a projected portion 43*a* rotationally coupled to the lever 43 and a bracket 44 to hold the crossbar assembly 41 and the bracket assembly 42 together. The projected portion 43*a* can be integral with the lever 43 or a separate component rotationally coupled to the lever 43. The projected portion 43*a* can be eccentric, non-eccentric or other shapes suitable for creating a compressive force between the lever 43 and the bracket 44.

Figure 5:
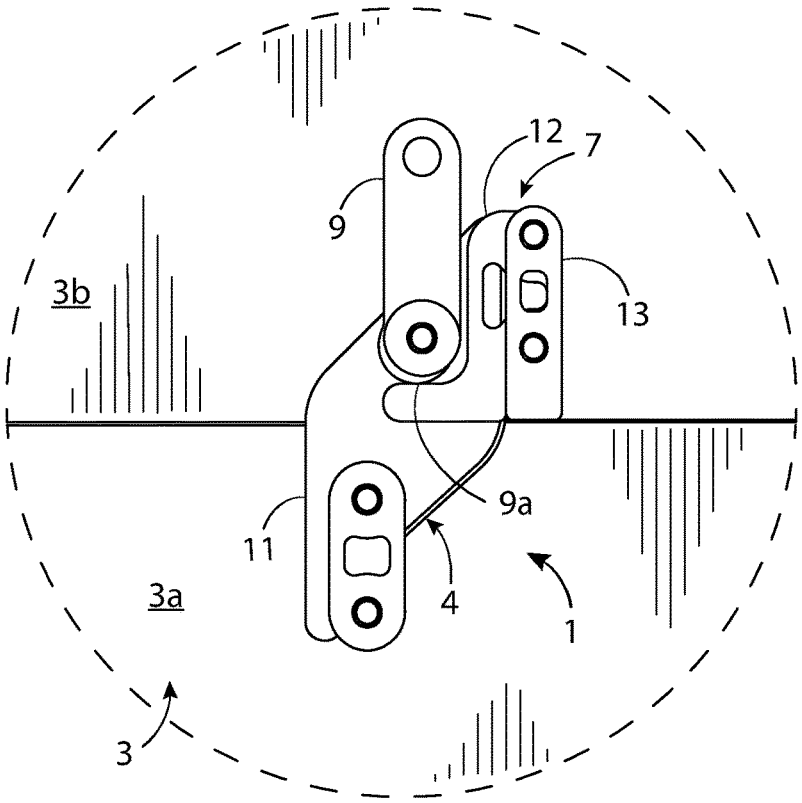
FIG. 5 illustrates an enlarged partial view of FIG. 3 showing one of the latching devices.
Figure 8:
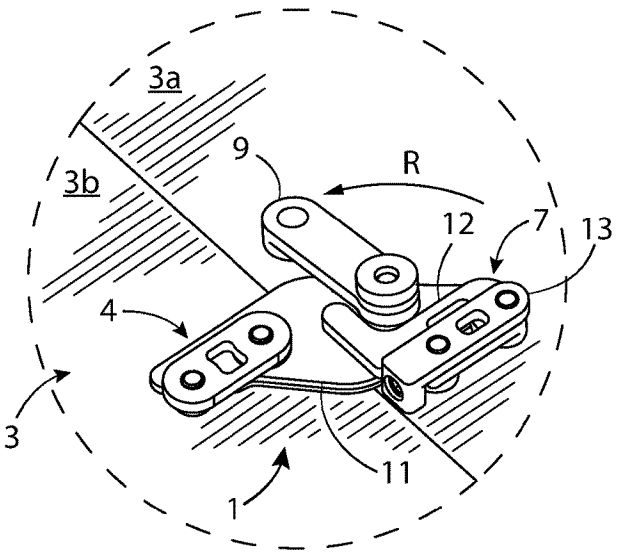
FIG. 8 illustrates an enlarged partial view of FIG. 7 showing one of the latching devices.
Figure 7:
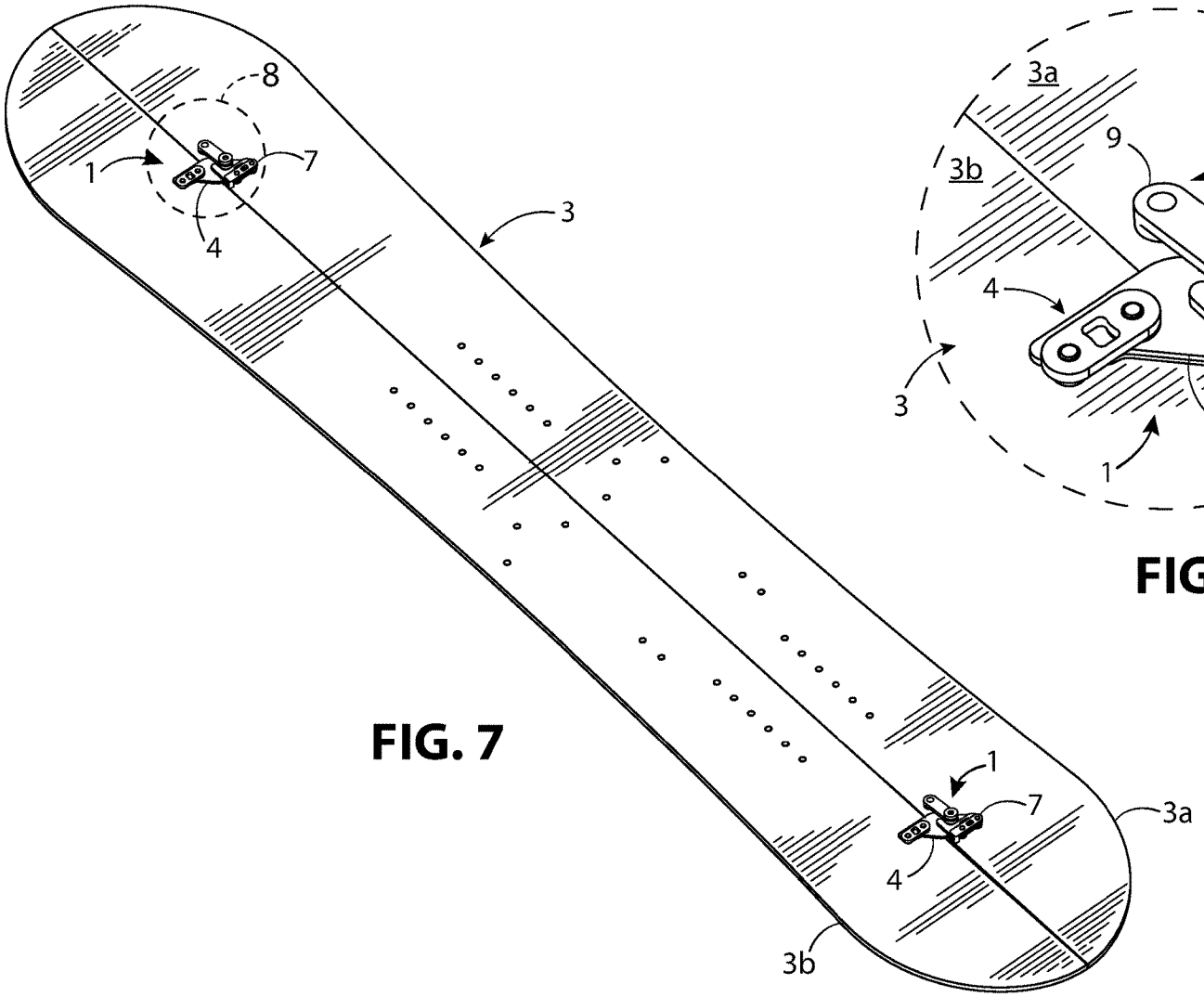
FIG. 7 illustrates in top perspective view, the splitboard and the pair of latching devices of FIG. 1 with the latching devices in an unlocked position.
Figure 9:
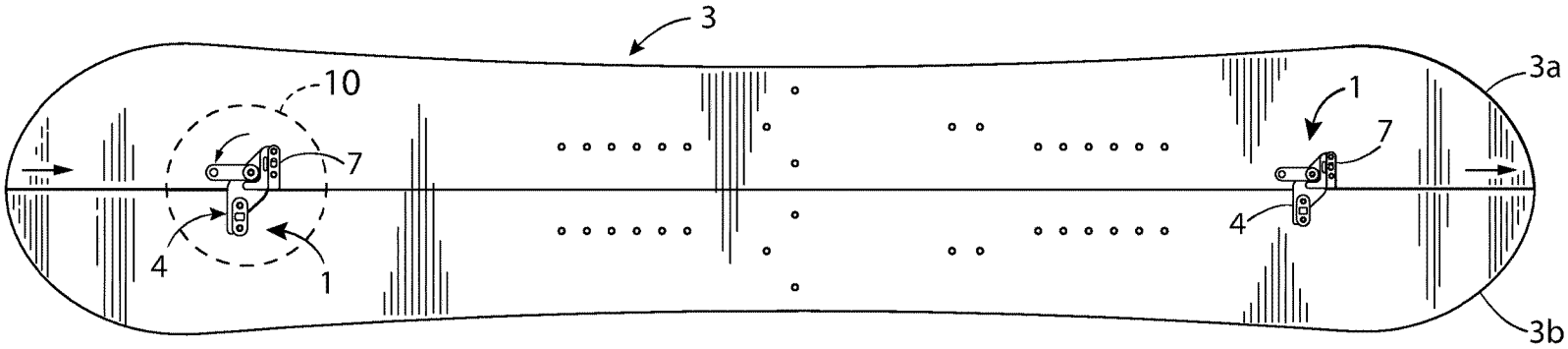
FIG. 9 illustrates a top view of the splitboard and latching devices of FIG. 7.
Figure 10:
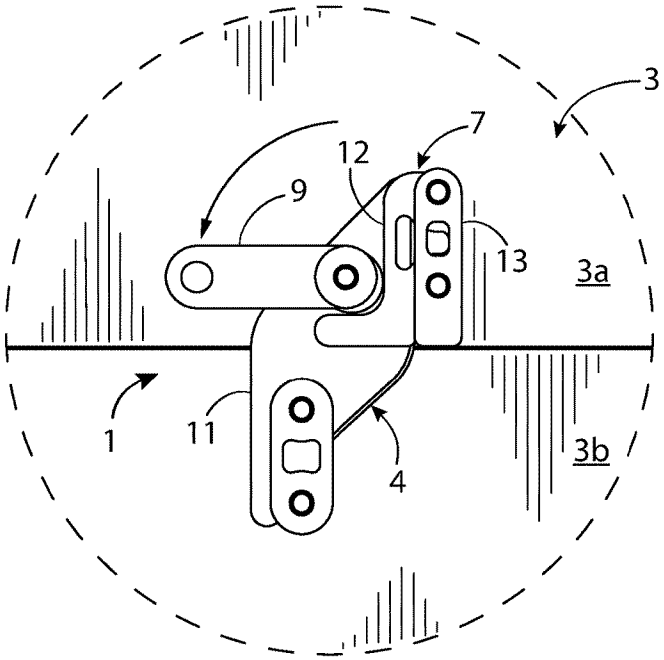
FIG. 10 illustrates an enlarged partial view of FIG. 9 showing one of the latching devices.
Figure 11:
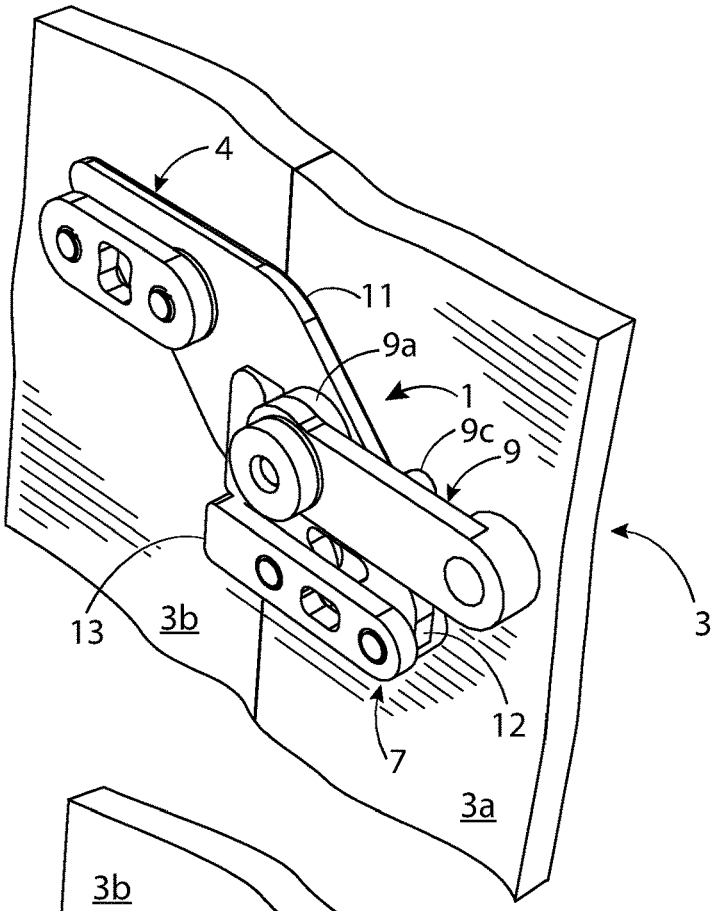
FIG. 11 illustrates an enlarged partial view of FIG. 1 taken from an alternative perspective to better illustrate aspects of the latching device.
Figure 12:
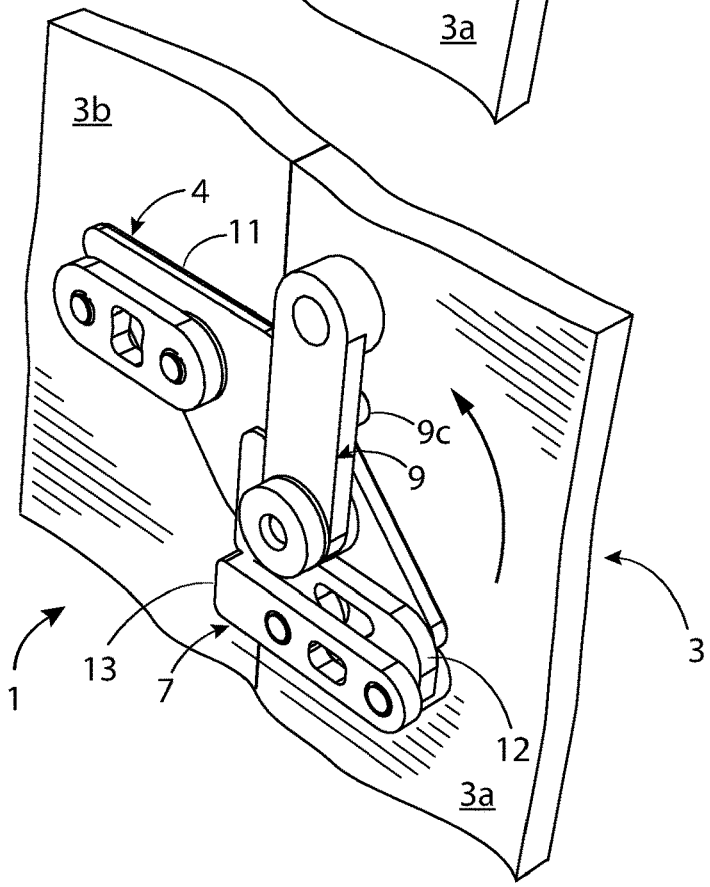
FIG. 12 illustrates an enlarge partial view of FIG. 7 taken from the same alternative perspective as FIG. 11.
Figure 14:
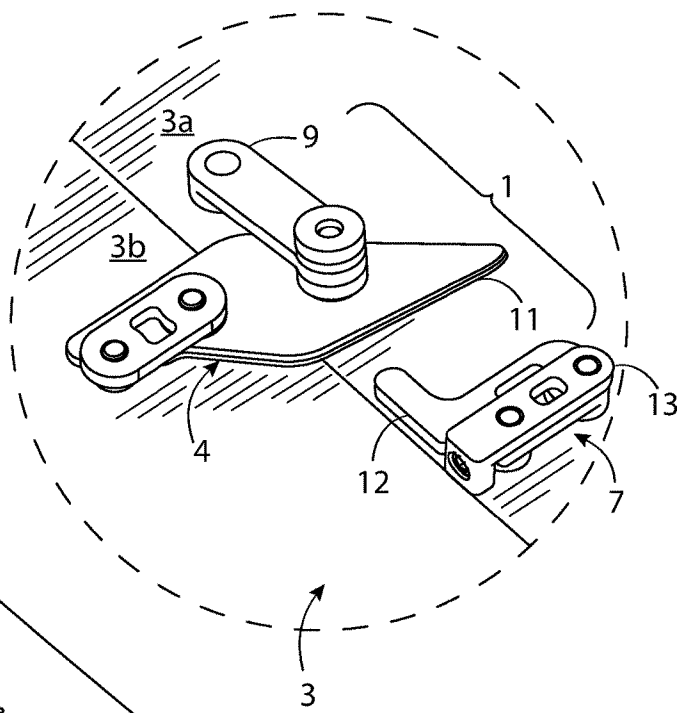
FIG. 14 illustrates an enlarged partial view of FIG. 13 showing one of the latching devices.
Figure 13:
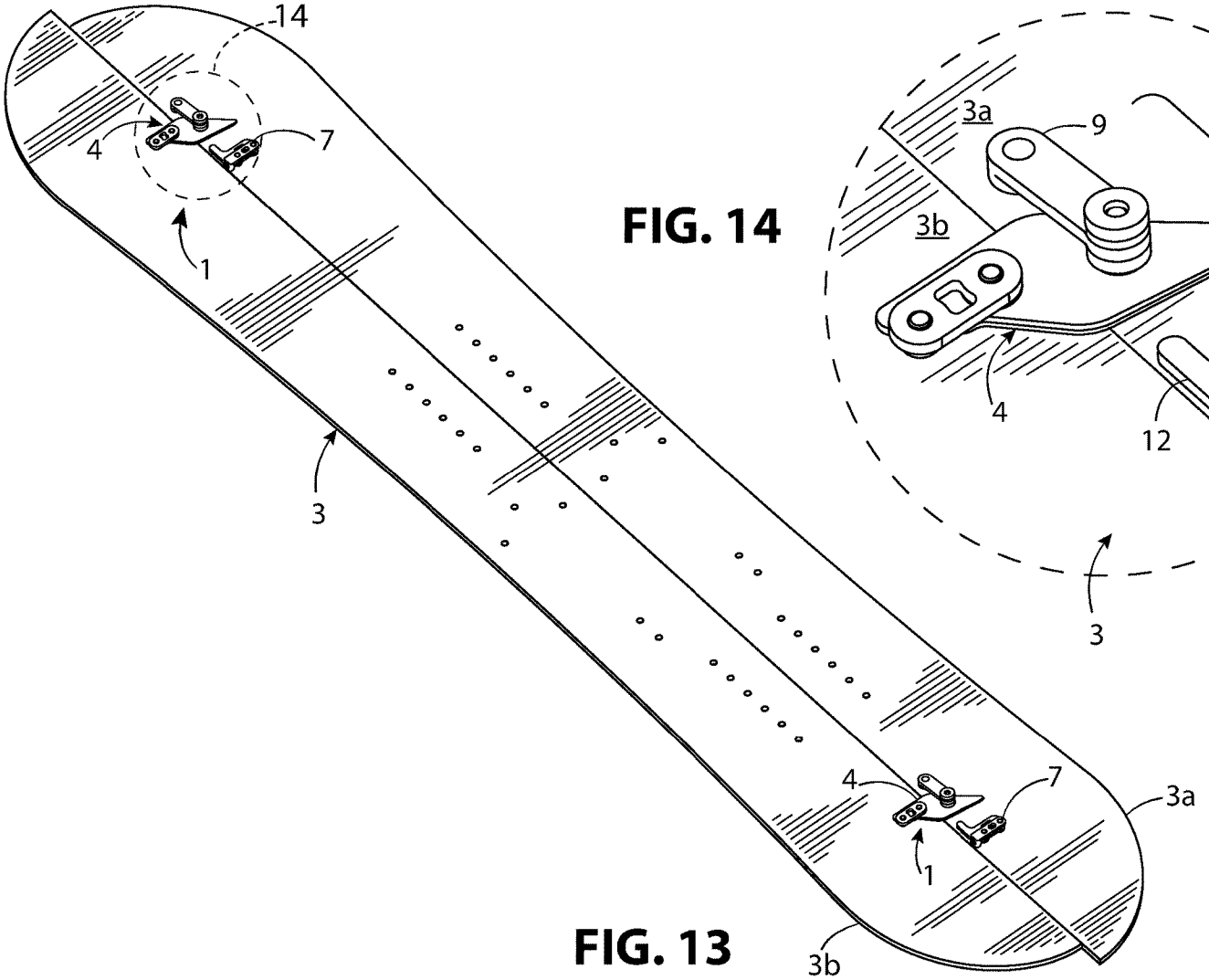
FIG. 13 illustrates in top perspective view, the splitboard and the pair of latching devices of FIG. 1 with the latching devices in the unlocked position of FIG. 7 and with the first splitboard ski slid free of the second splitboard ski.
Figure 15:
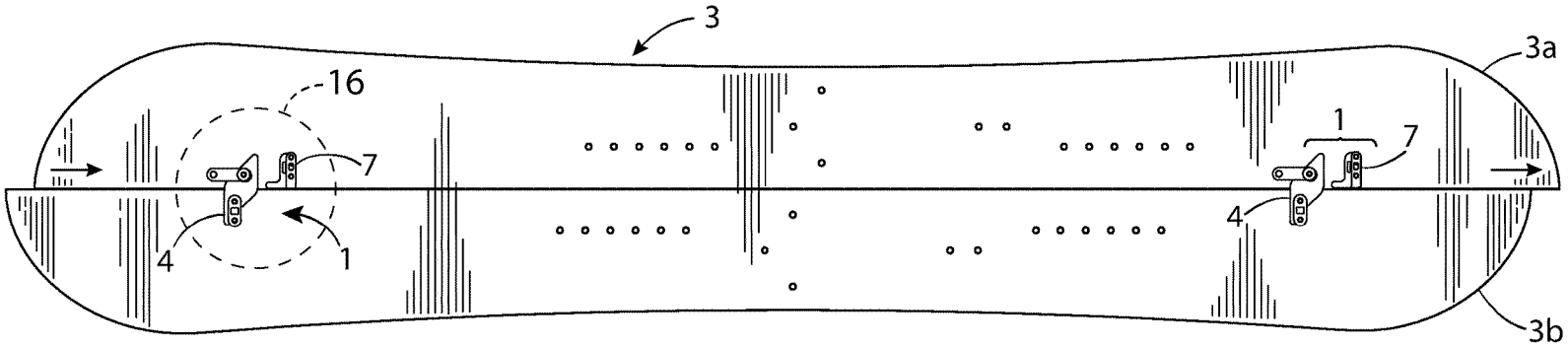
FIG. 15 illustrates a top view of the splitboard and latching devices of FIG. 13.
Figure 16:
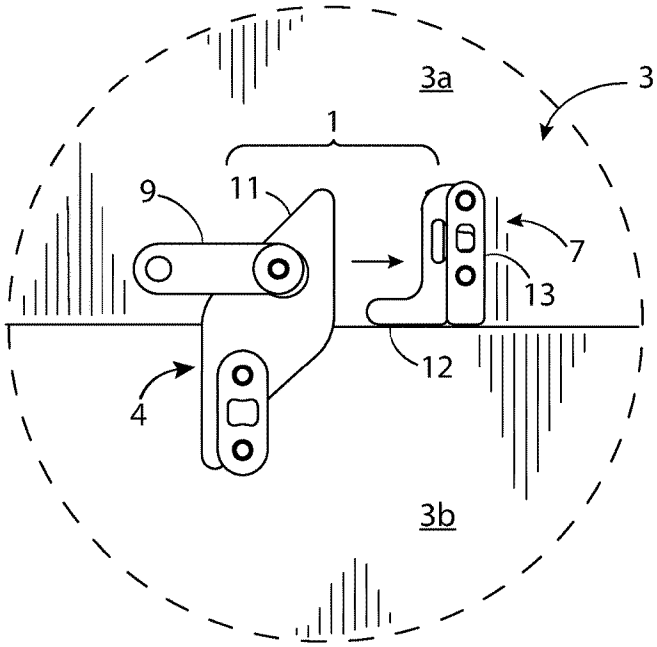
FIG. 16 illustrates an enlarged partial view of FIG. 15 showing one of the latching devices.
Figure 18:
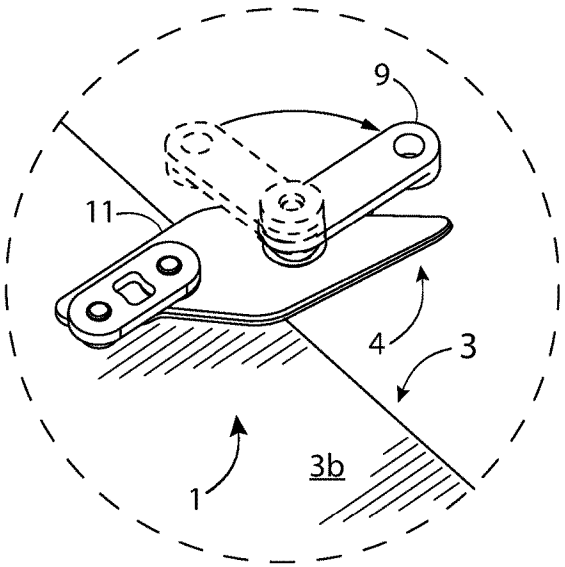
FIG. 18 illustrates an enlarged partial view of FIG. 17 showing one of the latching devices.
Figure 17:
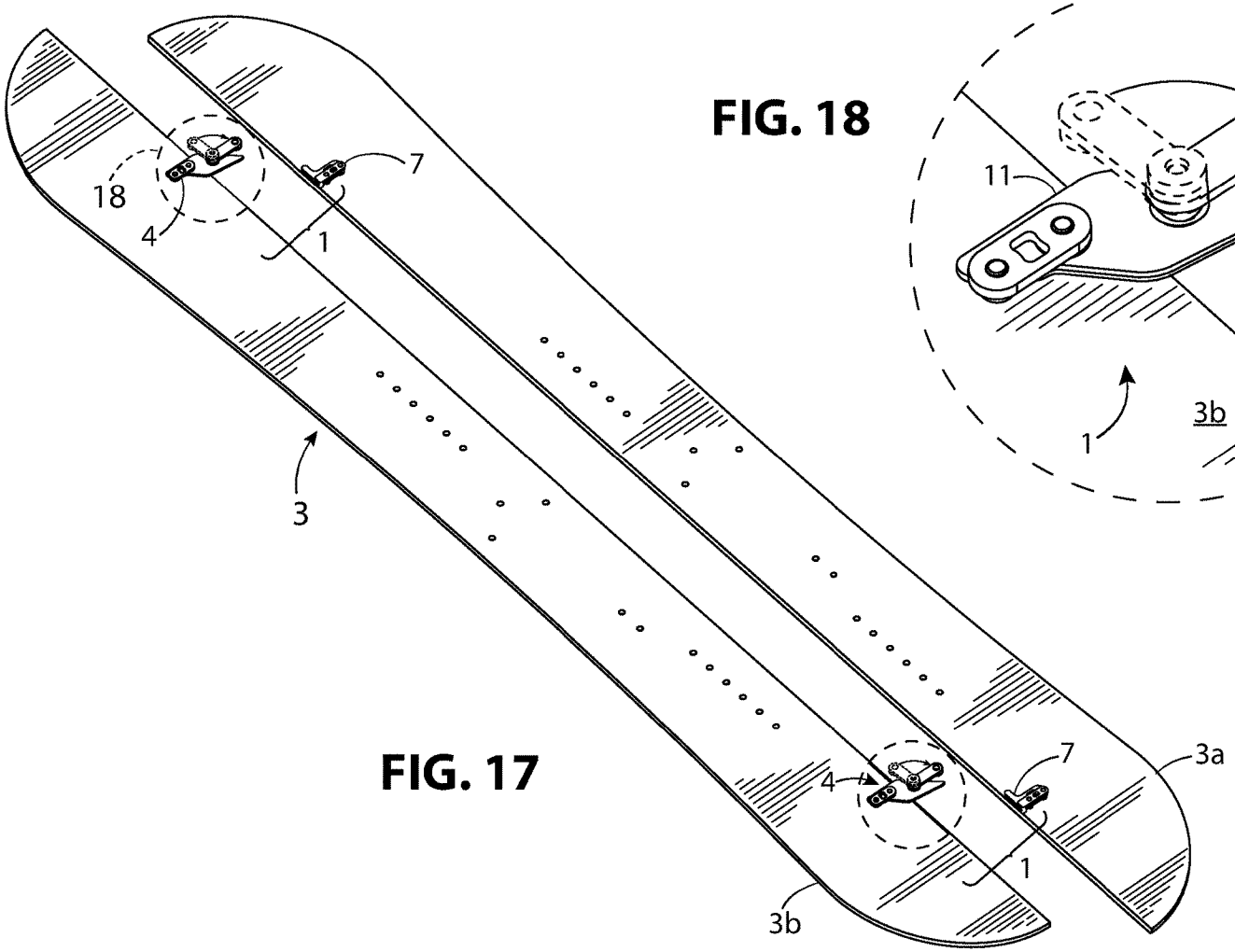
FIG. 17 illustrates in top perspective view, the splitboard and the pair of latching devices of FIG. 1 with the first splitboard ski slid free of the second splitboard ski and separated apart and with the levers of the latching devices rotated back to their position in FIG. 1.
Figure 19:
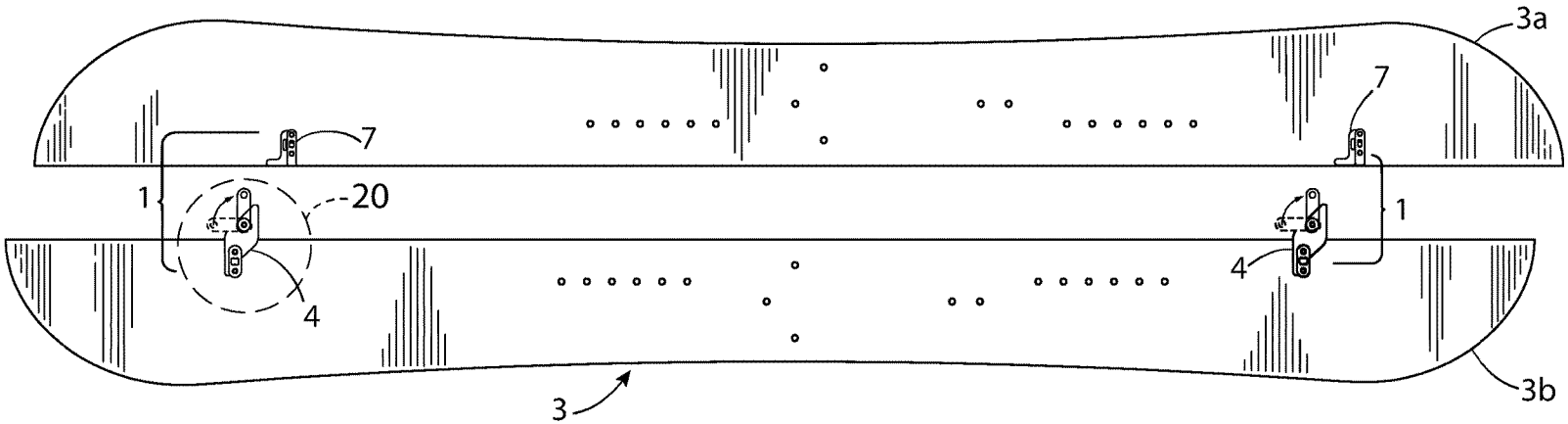
FIG. 19 illustrates a top view of the splitboard and latching devices of FIG. 17.
Figure 20:
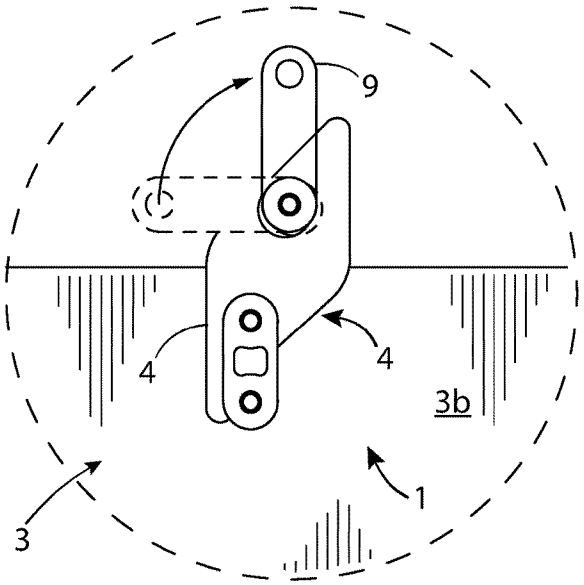
FIG. 20 illustrates an enlarged partial view of FIG. 19 showing one of the latching devices.
Figure 22:
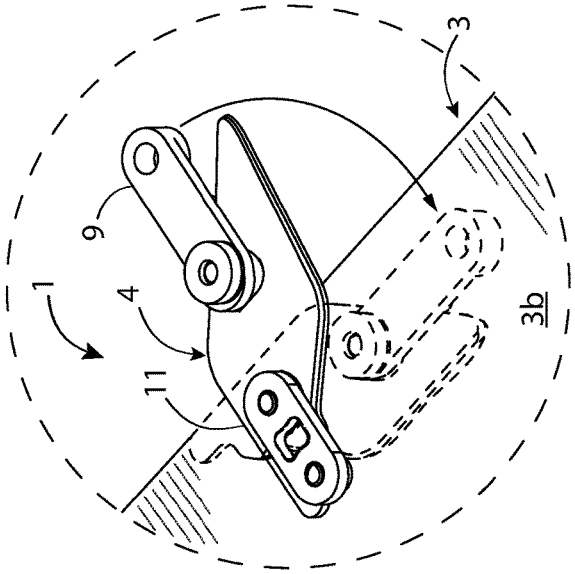
FIG. 22 illustrates an enlarged partial view of FIG. 21 showing one of the latching devices.
Figure 21:
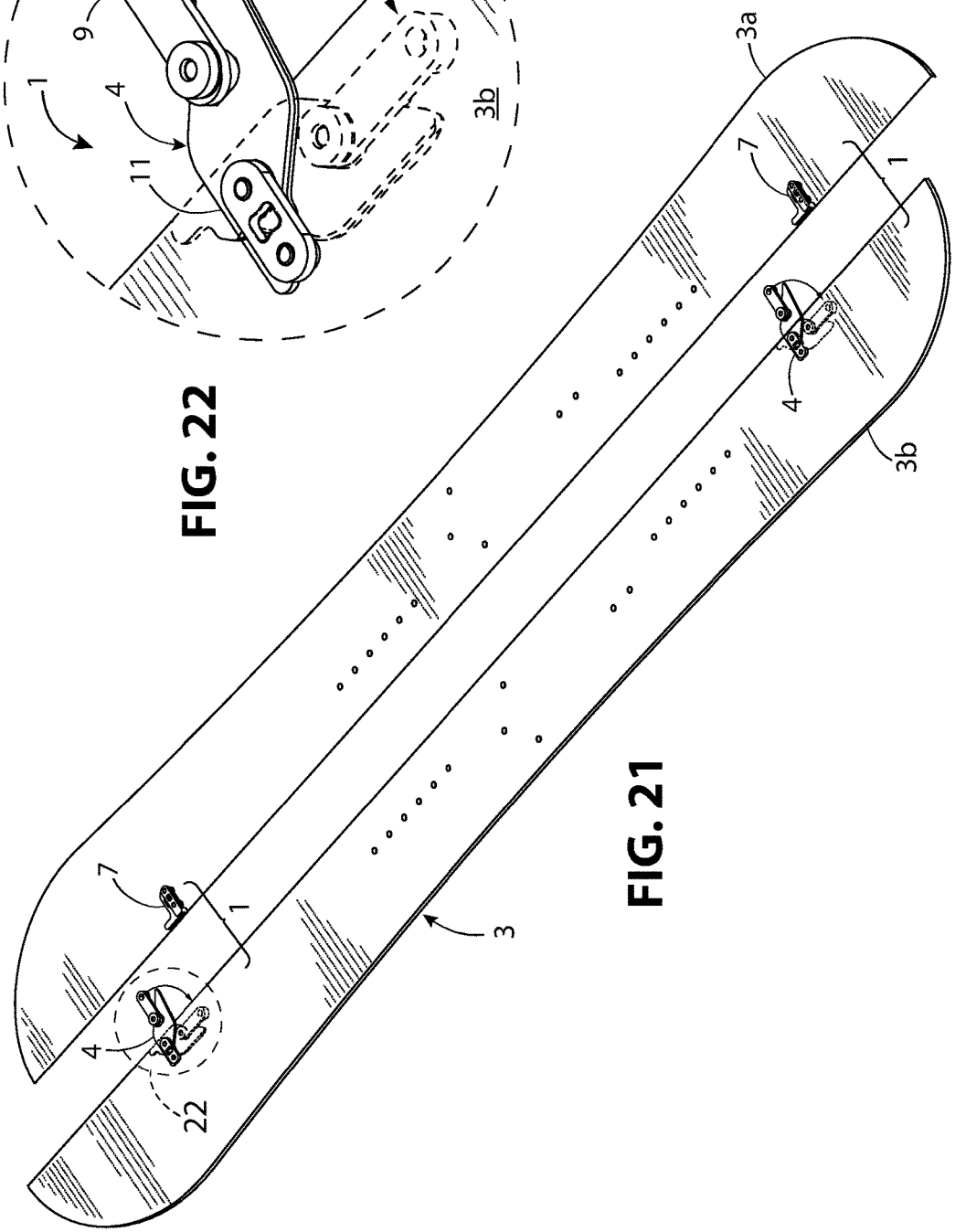
FIG. 21 illustrates in top perspective view, the splitboard and the pair of latching devices of FIG. 1 with the first splitboard ski and the second splitboard ski separated as in FIG. 17 where the lever and the crossbar are being rotated toward the second splitboard ski into a touring mode position.
Figure 23:
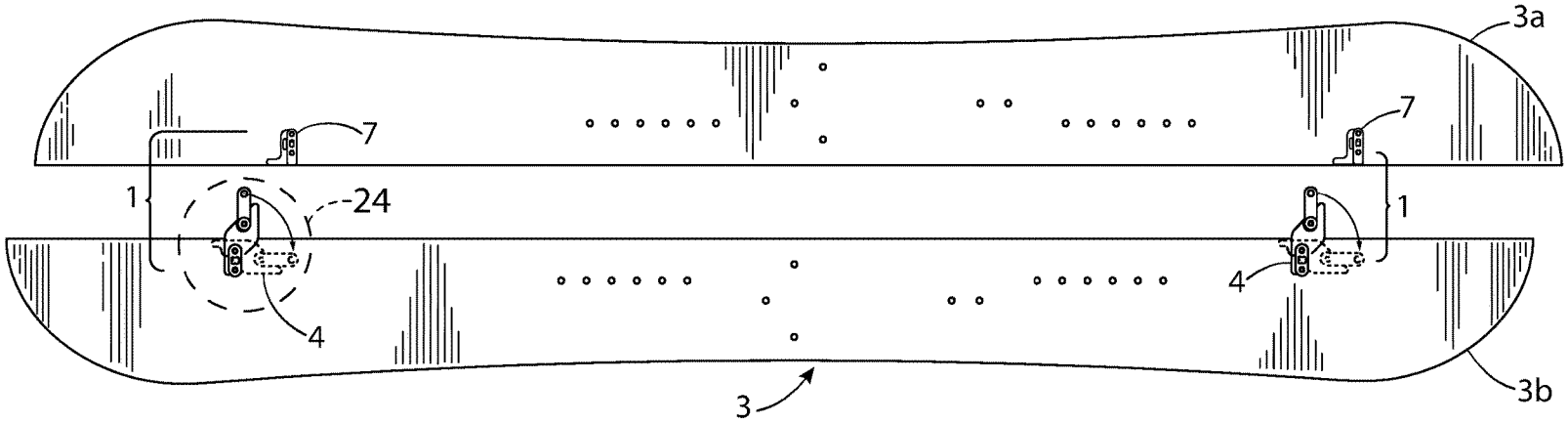
FIG. 23 illustrates a top view of the splitboard and latching devices of FIG. 21.
Figure 24:
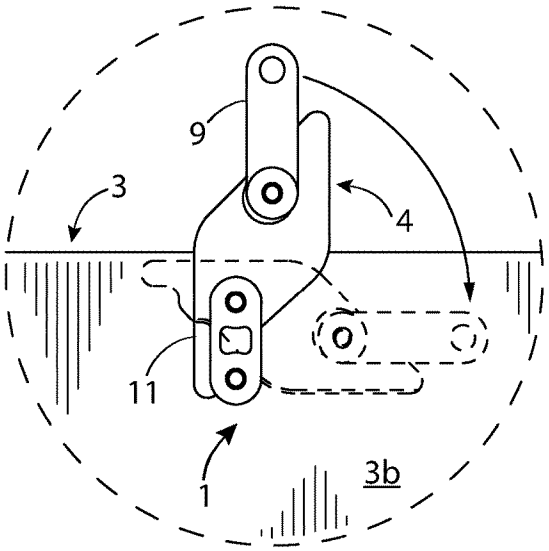
FIG. 24 illustrates an enlarged partial view of FIG. 23 showing one of the latching devices.
Figure 26:
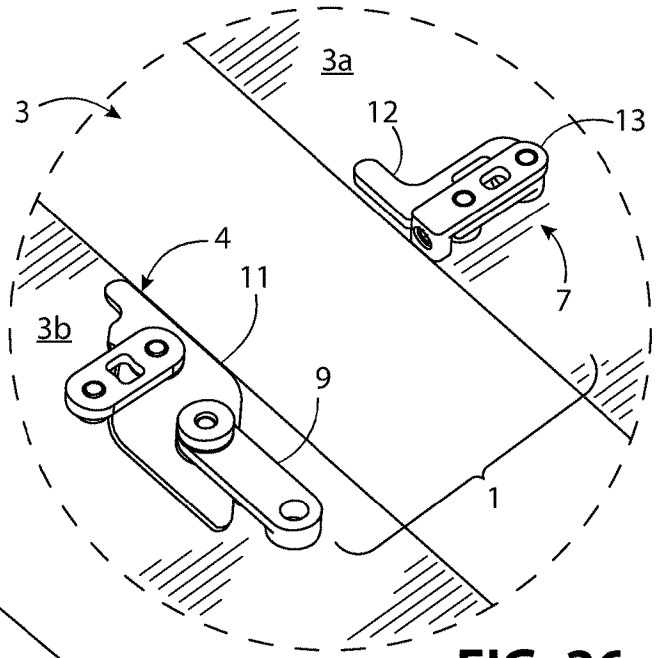
FIG. 26 illustrates an enlarged partial view of FIG. 25 showing one of the latching devices.
Figure 25:
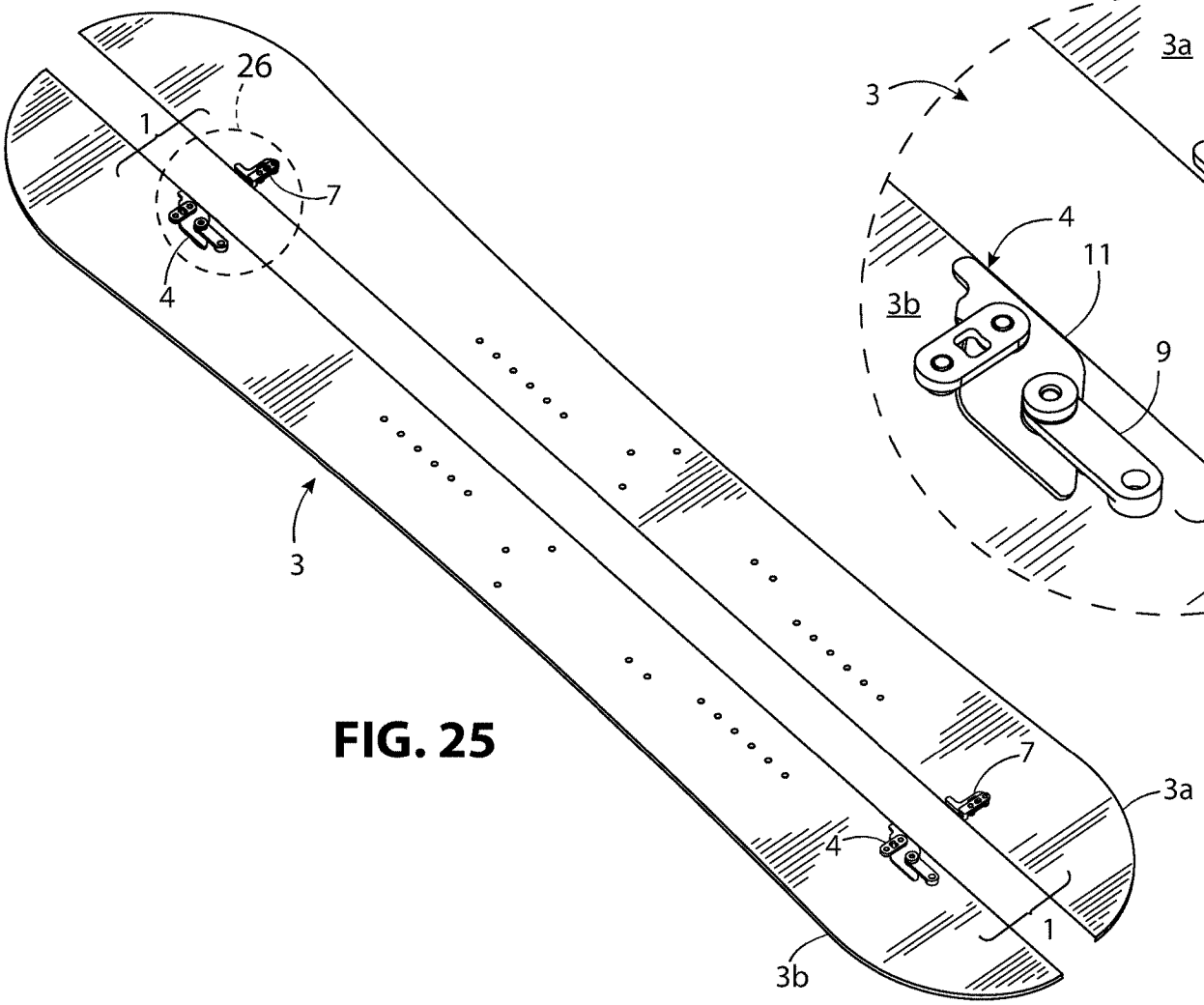
FIG. 25 illustrates in top perspective view, the splitboard and the pair of latching devices of FIG. 1 in touring mode.
Figure 27:
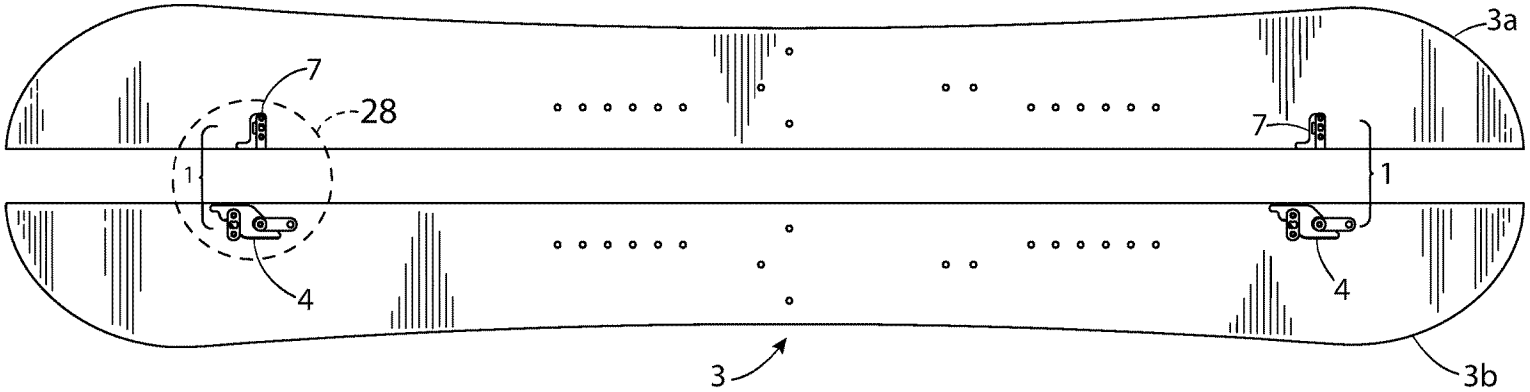
FIG. 27 illustrates a top view of the splitboard and latching devices of FIG. 25.
Figure 28:
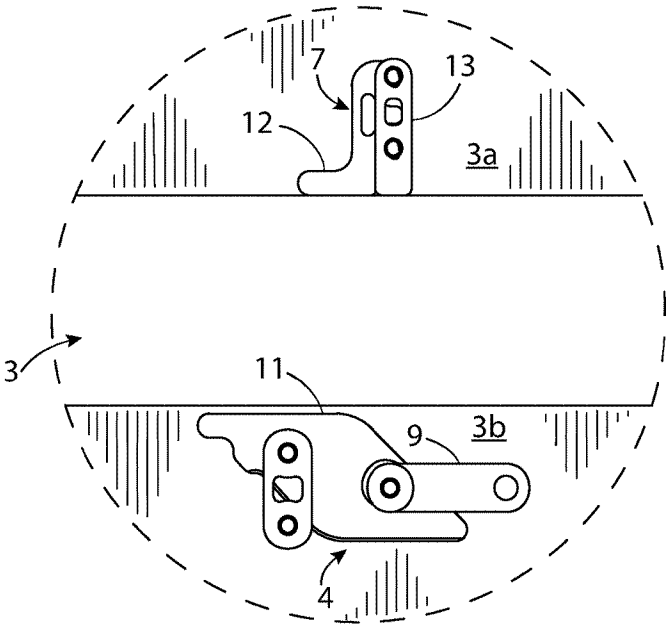
FIG. 28 illustrates an enlarged partial view of FIG. 27 showing one of the latching devices.

One difference between the latching device 1 of FIGS. 2, 5, 8, 10-13, 16, 18, 20, 22, 24, 26, 28, 30, 31 and the latching device 40 of FIGS. 38-42 is the rotation angle of the lever 9, 43, respectively, between the locked and unlocked positions. Referring to FIGS. 2 and 8, the lever 9 the is rotated at an angle R=90° (FIG. 8) counterclockwise from the locked position (FIG. 2) to the unlocked position (FIG. 8). Referring to FIGS. 2 and 5, the projected portion 9*a* engages the bracket 12 within the bracket assembly 7. Referring to FIGS. 11 and 12, the lever 9 can have its angle of rotation restricted by a stop 9*c* projecting from the bottom of the lever 9 toward the crossbar top surface. The stop 9*c* engages the crossbar 11 on a side surface of the crossbar 11 at both the beginning and end of rotation. The side surface projects downward from the crossbar top surface toward the first splitboard ski 3*a*. The stop 9*c* is also illustrated in FIGS. 30, 31, and 33. In FIGS. 39 and 40, the lever 43 is rotated at an angle of 180° clockwise from the locked position (FIG. 39) to the unlocked position (FIG. 40). FIGS. 2, 8 and FIGS. 39 and 40, teach two examples of how a projected portion 9*a*, 43*a* and lever 9, 43 of a crossbar assembly 4, 41 can be rotated to engage and disengage the bracket 12, 44 of the bracket assembly 7, 42. The inventor envisions that it is well within the scope of his latching device 1, 40 to use other rotational engagement angles.

Referring to FIGS. 30 and 31, the engagement between the projected portion 9*a* of the lever 9 and the bracket 12 can be by direct contact or through intermediary member. For example, the projected portion 9*a* can be inset from the lever edge 9*b* near to the rotational axis 15 of the lever 9 with the engagement through an intermediary. For example, the intermediary can be the ring bushing 17 that surrounds the projected portion 9*a*. The projected portion 9*a* can define the lever edge 9*b* and engagement can be through direct contact. Direct contact between the projected portion 9*a* and bracket 12 is simpler, using less parts than using an intermediary. However, using an intermediary allows using a different material for the contact surface than the lever's material. For example, the lever 9 and bracket 12 (FIG. 30) can be for example, thermo-plastic, steel, titanium, or aluminum. The ring bushing 17, or other intermediary, could be made of the same materials or a different material such, as brass.

Using FIG. 30, we will discuss parts that could make up the latching device 1 of FIGS. 1-28 in more detail. Using FIGS. 34-37, we will discuss how to adjust the tension of the bracket assembly 7. Using FIGS. 31-33, we will discuss the lever 9 and typical associated hardware in relation to the crossbar 11 (FIG. 31). Referring to FIG. 30, the crossbar assembly 4 can include the crossbar 11, lever 9, and a bridge 19. The bridge 19 includes standoffs 19*a*, 19*b* projecting directly from the bridge 19 toward the second splitboard ski 3*b*. The standoffs 19*a*, 19*b* include threaded apertures 19*c*, 19*d*, respectively that pass through the bridge 19. The bridge 19 is secured to the second splitboard ski 3*b* by threaded fasteners 21, 23 threadably engaging the threaded apertures 19*c*, 19*d*, respectively. The threaded fastener 21 engages the standoff 19*a* through an aperture 11*a* in the crossbar 11 and a washer 25 between the crossbar 11 and the standoff 19*a*. The threaded fastener 23 engages the standoff 19*b* without engaging the crossbar 11. Aperture 11*a* can be non-threaded. This configuration allows the crossbar 11 to rotate about a rotational axis 27 while the bridge 19 remains stationary and fixed to the second splitboard ski 3*b* by the threaded fasteners 21, 23. The crossbar end 11*b* is shaped and positioned regarding the standoff 19*b*, that standoff 19*b* acts as a rotational stop for the crossbar 11.

Figure 6:
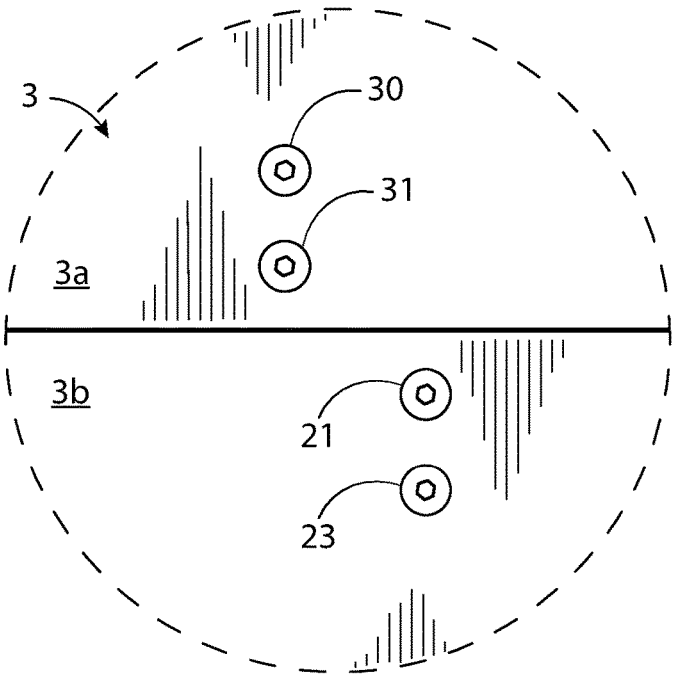
FIG. 6 illustrates an enlarged partial view of FIG. 4 showing threaded fasteners that secure the latching device of FIG. 5 to the splitboard.

Referring to FIGS. 30, and 34-37, the bracket assembly 7 can include the bracket base 13, the bracket 12, and a threaded fastener 29. The threaded fastener 29 shown is a set screw. The bracket base 13 includes standoffs 13*a*, 13*b* with threaded apertures 13*c*, 13*d* (FIG. 30), respectively. The threaded fastener 29 engages threaded aperture 13*e* in the vertical face 13*g* of the bracket base 13. The bracket 12 includes a first bracket portion 12*a* and a second bracket portion 12*b*. The bracket 12 can be an L-bracket with the second bracket portion 12*b* projecting upward from the first bracket portion 12*a*. The lengthwise axis of the second bracket portion 12*b* is illustrated as being parallel to the inside lengthwise edge 3*c* of the first splitboard ski 3*a*. The first bracket portion 12*a* includes standoffs 12*c*, 12*d*. The standoffs 12*c*, 12*d* include slots 12*e*, 12*f* respectively. Threaded fasteners 30, 31 threadably engage the threaded apertures 13*c*, 13*d* (FIG. 30) through slots 12*e*, 12*f*, respectively and secure the bracket base 13 to the first splitboard ski 3*a* while allowing the bracket 12 to slide along the slots perpendicular to the inside lengthwise edge 3*c* of the first splitboard ski 3*a*. Referring to FIG. 6, the heads of the threaded fasteners 21, 23 engage the bottom of the second splitboard ski 3*b*. The heads of threaded fasteners 30, 31 engage the bottom of the first splitboard ski 3*a*. The heads of the threaded fasteners 21, 23, 30, 31 can be countersunk into their respective splitboard skis so that the bottom surface of the splitboard 3 remains smooth. For insert-style splitboards, threaded fasteners 21, 23, 30, 31 do not secure the latching device 1 of FIG. 2 through the top of board. Instead the apertures are replaced with unthreaded apertures with threaded inserts installed into the unthreaded apertures from the top of the splitboard 3. The threaded fasteners 21, 23, 30, 31 can be threaded from the top of the bracket base 13 and the crossbar assembly 7 of FIG. 2 into the threaded inserts.

Figure 34:
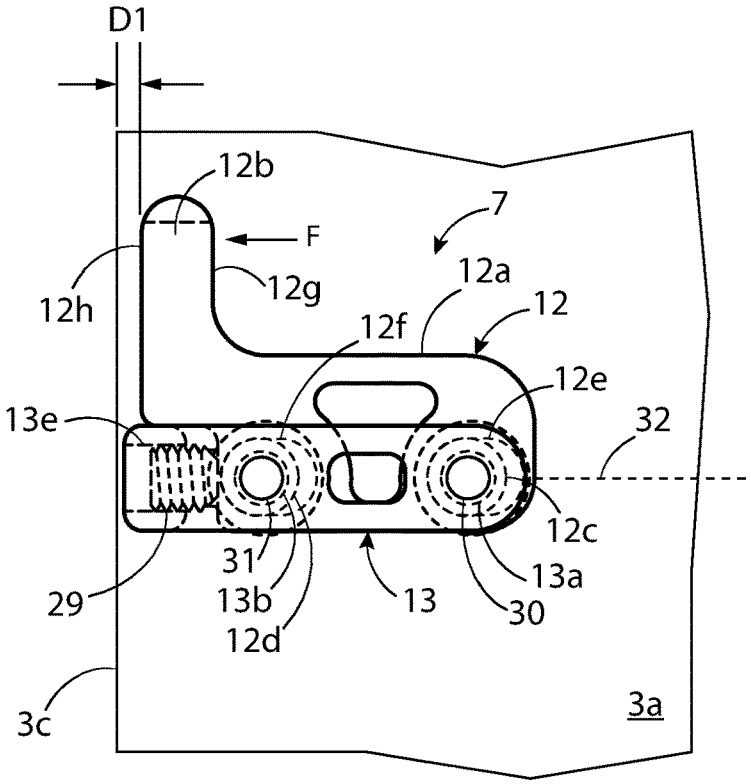
FIG. 34 illustrates a top, partial, and enlarged view of the bracket assembly and the first splitboard ski of FIG. 1 where the L-bracket is adjusted away from the lengthwise inside edge of the first splitboard ski and where dashed lines representing portions of the structure hidden from view.
Figure 35:
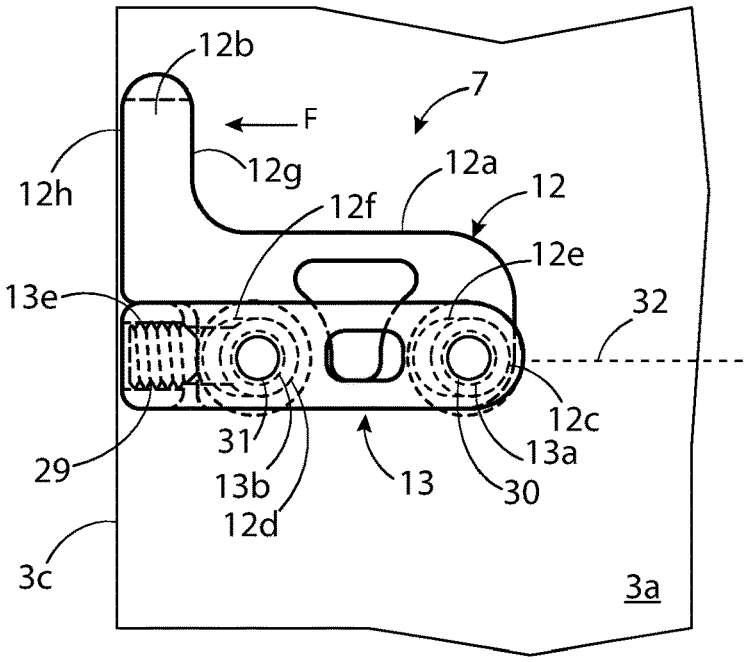
FIG. 35 illustrates the view of FIG. 34 where the L-bracket is adjusted toward the lengthwise inside edge of the first splitboard ski and where dashed lines representing portions of the structure hidden from view.
Figure 36:
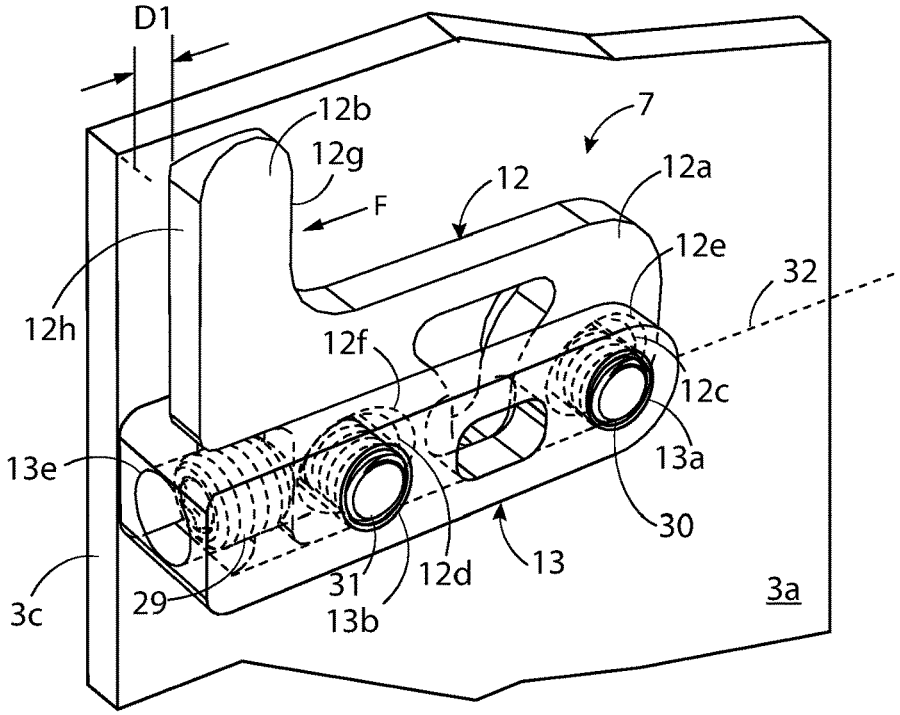
FIG. 36 illustrates a front perspective view of the bracket assembly adjusted as in FIG. 34 and where dashed lines representing portions of the structure hidden from view.
Figure 37:
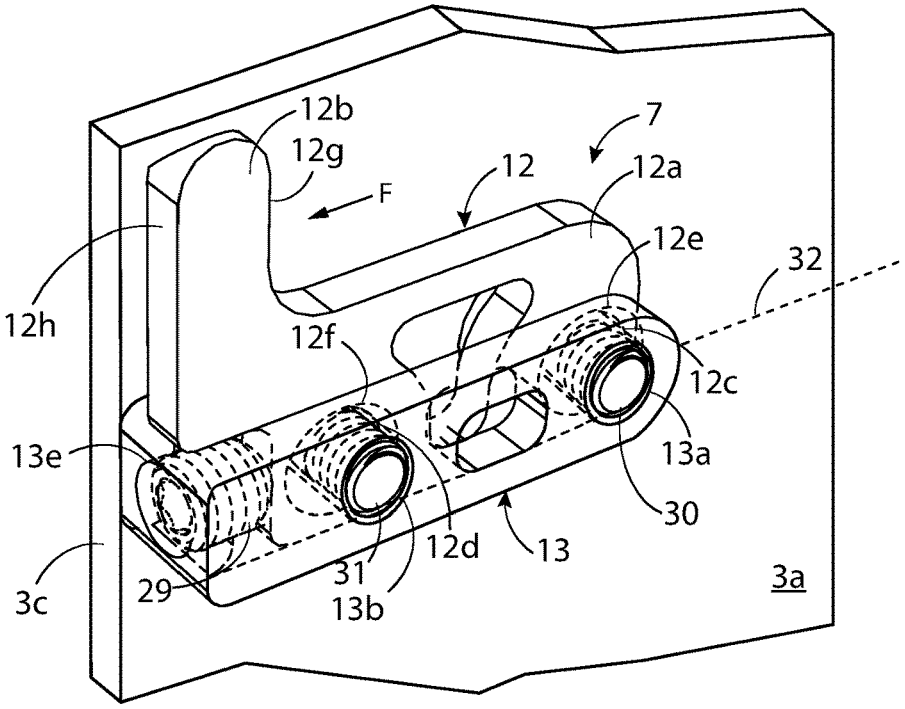
FIG. 37 illustrates a front perspective view of the bracket assembly adjusted as in FIG. 35 and where dashed lines representing portions of the structure hidden from view.
Figure 38:
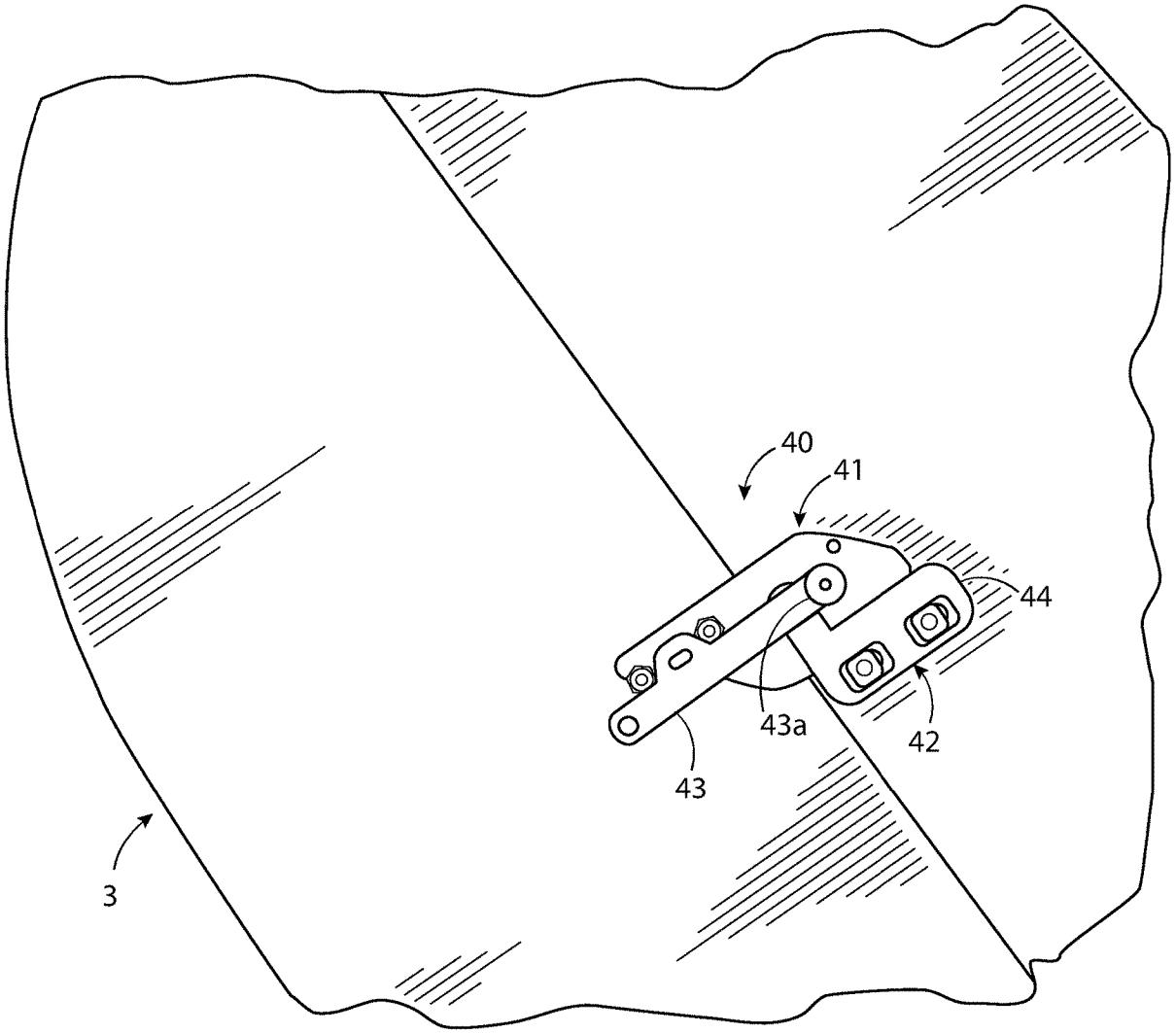
FIG. 38 illustrates in top perspective view, an upper portion of a splitboard with an alternative version of a latching device of the present disclosure.

Referring to FIGS. 34-37, one advantage of latching device 1 of FIGS. 1-3, 5, 7-17, 19, 21, 23, 25-28, 30 and 31, is that the compressive force between the crossbar assembly 4 and the bracket assembly 7 can be adjusted by a single threaded fastener, for example, a set screw. This threaded fastener 29 allows for fine adjustment and is independent of the fasteners that retain the bracket assembly 7 to the first splitboard ski 3*a*. Once fine adjustment is made, the fasteners retaining the bracket assembly 7 can be further tightened while the bracket 12 is in the latched position to prevent movement of the bracket 12 when it is in the unlatched position. When the bracket base 13 is secured to the first splitboard ski 3*a*, the bracket 12 may move to the extent of the slots 12*e*, 12*f* along the lengthwise axis 32 of the bracket base 13. The threaded fastener 29 limits the extent of movement of the bracket 12 toward the inside lengthwise edge 3*c* of the first splitboard ski 3*a*. When a force F is applied to the inside edge 12*g* by the projected portion 9*a* of the lever 9 from FIG. 30, the movement of bracket 12 toward the inside lengthwise edge 3*c* will be limited by the position of the threaded fastener 29. In FIGS. 34 and 36, for example, with the threaded fastener 29 threaded inward into the threaded aperture 13*e*, when a force F is applied to the inside edge 12*g*, the outside edge 12*h* of the bracket 12 is a distance D away from the edge of the first splitboard ski 3*a*. In FIGS. 35 and 37, the threaded fastener 29 is threaded outward toward the opening of the threaded aperture 13*e*, when a force F is applied to the inside edge 12*g*, the outside edge 12*h* of the bracket 12 will approximately aligned with the inside lengthwise edge 3*c* of the first splitboard ski 3*a*. Once the splitboard rider adjusts the position of the bracket 12 using the threaded fastener 29, while in the latched position, the he or she can further tighten the threaded fasteners 30, 31 so the bracket 12 remains stationary while latched or unlatched.

Referring to FIGS. 30 and 31, we will describe the lever 9 in relation to the crossbar 11 in more detail. The lever 9 attaches to the crossbar 11 by a pivot 33 that passes through a washer 34, an aperture 9*d* in the lever 9, aperture 11*c* in the crossbar 11, with a threaded aperture 33*a* within the pivot 33 threadably engaging a threaded fastener 35. Referring to FIG. 31, the end of the pivot body 33*b* can be keyed 33*c* to the aperture 11*c* in the crossbar 11 so that once engaged with the aperture 11*c*, the pivot body 33*b* cannot rotate. The pivot body 33*b* also can include a smooth portion so the lever 9 may rotate about the pivot body 33*b* via aperture 9*d*.

Figure 32:
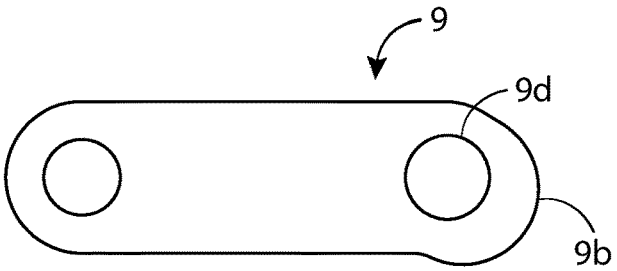
FIG. 32 illustrates a top view of the lever.

FIG. 32 shows a top view of the lever 9. FIG. 33 shows a bottom view of the lever 9. FIG. 32 shows the relationship between the aperture 9*d*, which is the center of rotation for the lever 9, and the lever edge 9*b* proximate to the center of rotation. FIG. 33 shows the relationship between the aperture 9*d*, the projected portion 9*a* and the lever edge 9*b*. The lever edge 9*b* proximate to the center of rotation is offset from the lengthwise axis of the lever 9. This creates an over center clamping action as the lever 9 engages the bracket 12 of FIG. 30. This prevents the lever 9 from working loose while riding because the maximum force is before the actual clamping position of the lever 9. This is just one example of a lever 9 within the scope of the latching device 1. The inventor envisions using levers 9 with projected portions 9*a*, eccentric portions, and lever edge 9*b* with shapes other than those of FIGS. 32 and 33. For example, the projected portion 9*a*, eccentric portion, or lever edge 9*b* can be a logarithmic spiral or can be a NURBS.

Referring to FIGS. 39 and 40, we will discuss the latching device 40 in more detail. The crossbar assembly includes the lever 43, a crossbar 45, pins 46, 47 projecting upward from the crossbar 45, and a threaded fastener 50 and a nut 49 or other threaded fastener retainers. The lever 43 includes a tab 43*b* projecting directly from one of the lengthwise edges of the lever 43. The tab 43*b* is located closer to the end of the lever 43 distal to the projected portion 43*a*. The tab 43*b* includes a slot 43*c*. Referring to FIG. 39, when the lever 43 is rotated toward the second splitboard ski 3*b* and is in the locked position, the tab 43*b* engages the pin 46. Referring to FIG. 40, when the lever 43 is rotated toward the first splitboard ski 3*a* (i.e., opposite of FIG. 39), the lever 43 is held in place by pin 47. Referring to FIG. 42, the crossbar 45 pivots about the threaded fastener 50 and nut 49. The crossbar 45 is stopped from pivoting in both its riding mode and touring mode positions by threaded fastener 51 and nut 52.

Referring to FIG. 39, the bracket assembly 42 includes the bracket 44, threaded fasteners 53, 54 and threaded retainers 55, 56. The bracket 44 includes inset portions 44*c*, 44*d* and slots 44*e*, 44*f* in the bottom surface of inset portions 44*c*, 44*d*, respectively. The threaded fasteners 53, 54 secure the bracket 44 to the first splitboard ski 3*a* by threadably engaging the threaded retainers 55, 56, respectively. The threaded fasteners 53, 54 pass through the slots 44*e*, 44*f* and engage the threaded retainers 55, 56 from within the inset portions 44*c*, 44*d*, respectively. The bracket 44 includes a first bracket portion 44*a* and a second bracket portion 44*b*. The bracket 44 is illustrated as an L-bracket with the lengthwise axis of the first bracket portion 44*a* approximately perpendicular to the lengthwise axis of the second bracket portion 44*b*. However, the inventor envisions that other bracket shapes can be used that fall within the spirit of the latching device 40.

The compressive force between the bracket 44 and the projected portion 43*a* of the lever 43 can be adjusted by loosening the threaded fasteners 53, 54, sliding the bracket 44 along the slots 44*e*, 44*f* to the desired position, and then retightening to adjust the fasteners.

Described are latching devices in several examples, for securing the first splitboard ski 3*a* and the second splitboard ski 3*b* in a splitboard 3. This disclosure does not intend to limit the claimed invention to the examples, variations, and exemplary embodiments described in the specification. Those skilled in the art will recognize that variations will occur when embodying the claimed invention in specific implementations and environments. For example, the bracket 12 of FIGS. 2, 5, 8, 10, 11, 12, 14, 16, 26, and 28, and the bracket 44 of FIGS. 39-42 are L-shaped. The inventor conceives that other bracket shapes are within the scope of the latching device 1, 40. For example, a linear bar positioned parallel to the inside lengthwise edge 3*c* of the first splitboard ski 3*a* can replace brackets 12, 44. This linear bar can engage the projected portions 9*a*, 43*a* in a similar manner as described for the brackets 12, 44. The bracket 12, 44, or variations of the bracket, such as the linear bar, could be fixed directly to the first splitboard ski 3*a*. There, for example, the bracket assembly 7 could include a bracket 12 and threaded fasteners and not require a bracket base 13. The bracket 12, 44 may be integrally formed or constructed of several pieces. Similarly, the crossbar 11, 45 may be integrally formed or constructed of several pieces. For splitboards with threaded inserts for mounting splitboard latching devices, the threaded fasteners 30, 31 in FIGS. 34-37 can be threaded from the top of the bracket base 13 into the threaded inserts that are inserted into non-threaded apertures rather than through threaded apertures from the bottom of the splitboard.

It is possible to implement certain features described in separate embodiments in combination within a single embodiment. Similarly, it is possible to implement certain features described in single embodiments either separately or in combination in multiple embodiments. For example, the bracket assembly 7 of FIGS. 2, 5, 8, 10, 11, 12, 14, 16, 26, and 28 can readily be substituted for the bracket assembly 42 of FIGS. 39-42 with some minor modifications to the crossbar assembly 41. Similarly, the bracket assembly 42 can be used with the crossbar assembly 4. The inventor envisions these and other variations fall within the scope of the claimed invention.

Threaded fasteners are discussed throughout the Description. Threaded fasteners can be any threaded fastener capable of performing the function the described. For example, threaded fasteners for holding either the bracket or crossbar assemblies to their respective splitboard skis can be any threaded fastener capable of performing that function. Typical these could be machine thread screws. However, bolts or other threaded fasteners could be readily substituted. The threaded fastener 29 in FIGS. 32-34 can be any threaded fastener capable of acting as a threaded adjustment device. Typically, a set screw can be used. However, other threaded fasteners can be readily substituted. Threaded fasteners in the Description are often depicted with hexagonal recess or "Allen" heads (i.e., capable of being driven by a hexagonal head or Allen head wrench or tool). Philips, slot, Frearson, clutch, square recess, tri-wing, a recessed star pattern often sold under the registered trademark TORX® by Textron Industries, Inc, and other tool receiving heads known in the art can be readily substituted.

The appended claims are not to be interpreted as including means-plus-function limitations, unless a claim explicitly evokes the means-plus-function clause of 35 USC § 112 para (f) by using the phrase "means for" followed by a verb in gerund form.

A "method" as disclosed herein refers to one or more steps or actions for achieving the described end. Unless a specific order of steps or actions is required for proper operation of the embodiment, the order and/or use of specific steps and/or actions may be modified without departing from the present invention.

"Optional" or "optionally" is used throughout this disclosure to describe features or structures that are optional. Not using the word optional or optionally to describe a feature or structure does not imply that the feature or structure is essential, necessary, or not optional.

While the examples and variations are helpful to those skilled in the art in understanding the claimed invention the claimed invention is defined solely by the claims and their equivalents.

What is claimed is:

1. A latching device for latching a first splitboard ski and a second splitboard ski, comprising:

a bracket secured to the first splitboard ski;

a crossbar assembly secured to the second splitboard ski, the crossbar assembly comprising a crossbar and a lever;

the lever rotationally coupled to the crossbar with an axis of rotation projecting through a top surface of the second splitboard ski; and with the crossbar assembly being engaged with the bracket, rotation of the lever applies a compressive force between the crossbar assembly and the bracket.

2. The latching device of claim 1, wherein:

the bracket includes an inside edge facing away from the second splitboard ski; and with the crossbar assembly being engaged with the bracket, rotation of the lever applies the compressive force between the lever and the inside edge of the bracket.

3. The latching device of claim 2, wherein:

the lever includes an eccentric portion that is eccentric to a rotational axis of the lever; and the rotation of the lever applies the compressive force between the eccentric portion and the inside edge of the bracket.

4. The latching device of claim 2, wherein:

the inside edge of the bracket is parallel to an inside lengthwise edge of the first splitboard ski.

5. The latching device of claim 2, wherein:

the crossbar being rotatable to overlap the first splitboard ski when the lever engages the inside edge of the bracket; and the crossbar being rotatable to constrain the crossbar assembly within a perimeter boundary of the second splitboard ski.

6. The latching device of claim 1, wherein:

the crossbar includes a crossbar top surface facing away from the top surface of the second splitboard ski and a side surface projecting from the crossbar top surface toward the top surface of the second splitboard ski;

the lever includes a stop that projects from the lever toward the crossbar top surface; and the stop engages the side surface defining a beginning and an end of rotation of the lever.

7. The latching device of claim 1, further comprising:

a bracket assembly, the bracket assembly includes the bracket and a base;

the bracket includes a first bracket portion being constrained to slide within the base and a second bracket portion that includes an inside edge of the bracket; and a threaded fastener by threaded engagement with the base and engagement with the inside edge of the bracket restrains movement of the bracket to a fixed position with respect to an inside lengthwise edge of the first splitboard ski.

8. The latching device of claim 2, wherein:

the bracket is an L-bracket with a first bracket portion parallel to an inside lengthwise edge of the first splitboard ski; and the first bracket portion includes the inside edge of the bracket.

9. A latching device for latching a first splitboard ski and a second splitboard ski of a splitboard with the first splitboard ski including an inside lengthwise edge, comprising:

a bracket assembly including a base, a bracket, and a threaded fastener;

the bracket includes a first bracket portion constrained to slide along the base and a second bracket portion projecting away from the first bracket portion and the base, the second bracket portion includes an inside edge facing away from the second splitboard ski; and the threaded fastener by threaded engagement with the base and engagement with the inside edge of the bracket restrains movement of the bracket to a fixed position with respect to the inside lengthwise edge of the first splitboard ski.

10. The latching device of claim 9, wherein the first bracket portion is parallel to the inside lengthwise edge of the first splitboard ski.

11. The latching device of claim 9, wherein the bracket is an L-bracket with the first bracket portion parallel to the inside lengthwise edge of the first splitboard ski and the second bracket portion being approximately perpendicular to the first bracket portion.

12. The latching device of claim 9, wherein:

the first bracket portion includes a slot;

the base includes a standoff rigidly attached to the first splitboard ski and projecting through the slot; and the slot defines a range of movement of the bracket in a direction away from the second splitboard ski.

13. The latching device of claim 9, wherein:

the first bracket portion includes a first slot and a second slot;

the base includes a first standoff and a second standoff in fixed positions with respect to the first splitboard ski;

the first standoff projecting through the first slot and the second standoff projecting through the second slot; and the first slot and the second slot define a range of movement of the bracket in a direction away from the second splitboard ski.

14. The latching device of claim 9, further comprising:

the threaded fastener is a third threaded fastener;

a first threaded fastener and a second threaded fastener;

the first bracket portion includes a first slot and a second slot;

the base includes a first standoff and a second standoff;

the first standoff projecting through the first slot and the second standoff projecting through the second slot;

the first threaded fastener secures the first standoff to the first splitboard ski and the second threaded fastener secures the second standoff to the first splitboard ski; and the first slot and the second slot define a range of movement of the bracket in a direction away from the second splitboard ski.

15. A latching device for latching a first splitboard ski and a second splitboard ski of a splitboard, the first splitboard ski including an inside lengthwise edge and a first top surface and the second splitboard ski including a second top surface, comprising:

a bracket secured to the first top surface and constrained to lie within the inside lengthwise edge;

a crossbar assembly secured to the second top surface, the crossbar assembly includes a crossbar; and a portion of the crossbar is positioned between the bracket and the first splitboard ski, preventing both up and down movement between the first splitboard ski and the second splitboard ski;

the crossbar assembly includes a lever rotationally coupled to the crossbar; and with the crossbar assembly being engaged with the bracket, rotation of the lever applies a compressive force between the crossbar assembly and the bracket applying a holding force between the first splitboard ski and the second splitboard ski.

16. The latching device of claim 15, wherein:

the bracket includes an inside edge facing away from the second splitboard ski; and rotation of the lever applies the compressive force between the lever and the inside edge of the bracket applying the holding force between the first splitboard ski and the second splitboard ski.

17. The latching device of claim 16, wherein:

the lever having an axis of rotation perpendicular to projecting upwardly away from the second top surface.

18. A latching device for latching a first splitboard ski and a second splitboard ski of a splitboard, comprising:

a bracket secured to the first splitboard ski;

a crossbar assembly secured to the second splitboard ski, the crossbar assembly comprising a crossbar and a lever;

the lever rotationally coupled to the crossbar; and with the crossbar assembly being engaged with the bracket, rotation of the lever applies a compressive force between the crossbar assembly and the bracket.

19. The latching device of claim 18, wherein:

the lever includes an eccentric portion eccentric to a rotational axis of the lever.

20. The latching device of claim 18, wherein the crossbar is rotationally coupled to the second splitboard ski.

21. The latching device of claim 18, wherein the crossbar being rotatable to be completely within an outside perimeter boundary of the second splitboard ski.

* * * * *